US005267536A

United States Patent [19]

Imagawa et al.

[11] Patent Number: 5,267,536

[45] Date of Patent: Dec. 7, 1993

[54] FOUR-STROKE ENGINE HAVING AN IMPROVED VALVE MECHANISM

[75] Inventors: Youichi Imagawa; Hiroshi Kohmoto; Jens K. Olsen, all of Tokyo, Japan

[73] Assignee: Ryobi Limited, Tokyo, Japan

[21] Appl. No.: 801,709

[22] Filed: Dec. 2, 1991

[30] Foreign Application Priority Data

Nov. 30, 1990 [JP] Japan ..... 2-338741
Dec. 27, 1990 [JP] Japan ..... 2-405481[U]
Mar. 29, 1991 [JP] Japan ..... 3-28540[U]

[51] Int. Cl.[5] ..... F01L 1/26

[52] U.S. Cl. ..... 123/90.23; 123/41.65; 123/41.7

[58] Field of Search ..... 123/90.1, 90.22, 90.23, 123/90.31, 41.56, 41.65, 41.7

[56] References Cited

U.S. PATENT DOCUMENTS 1,458,223 6/1923 Edwards ..... 123/90.23

FOREIGN PATENT DOCUMENTS 352185 3/1961 Switzerland ..... 123/90.23

*Primary Examiner*—Noah P. Kamen
*Attorney, Agent, or Firm*—Brooks & Kushman

[57] ABSTRACT

A four-stroke cycle engine unit for a working machine, for example, generally a valve drive mechanism for driving the exhaust and intake valves. The valve drive mechanism comprises a crank cam assembly mounted to a crank shaft of the engine unit so as to be rotated in accordance with rotation of the crank shaft, a cam gear assembly mounted on the cam shaft and meshed with the crank cam assembly, a cam assembly mounted onto the cam gear assembly so as to be rotated in accordance with rotation of the cam gear assembly, a pair of first and second lifters mounted on a lifter axis portion positioned in parallel to the crank shaft, the lifters being rocked in accordance with rotation of the cam assembly, a pair of first and second push rods lifted up and lowered in accordance with rocking motions of the first and second lifters, respectively, and a pair of first and second rocker arms operated in association with the first and second push rods. The lifter axis portion and the cam shaft are positioned in a plane including the crank and a center line of a cylinder of a piston-cylinder assembly of the engine unit. The first rocker arm is connected to the exhaust valve so as to carry out open-close operation thereof and the second rocker arm is connected to the intake valve so as to carry out open-close operation thereof.

27 Claims, 29 Drawing Sheets

FIG. 20A
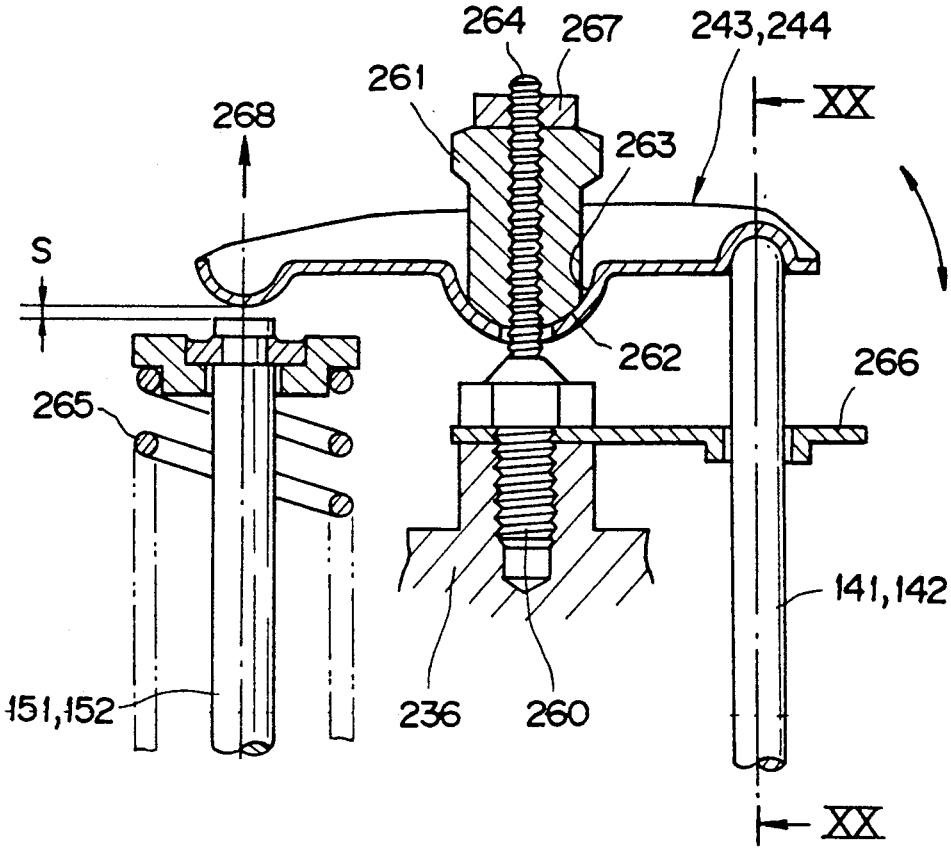
FIG. 20B FIG. 20C
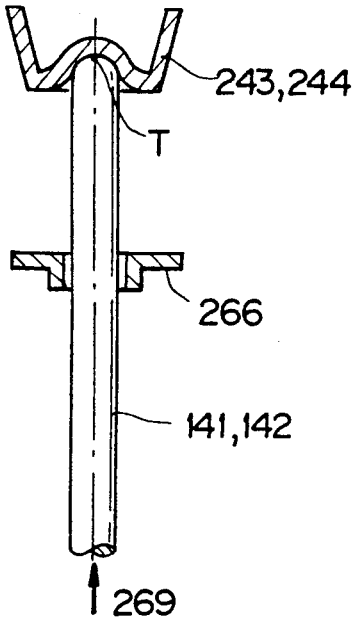
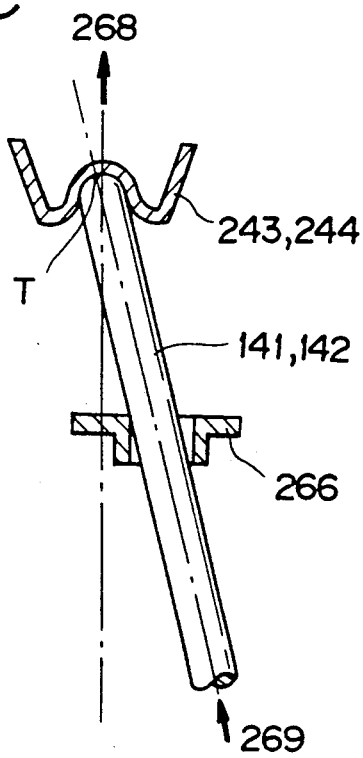

FOUR-STROKE ENGINE HAVING AN IMPROVED VALVE MECHANISM

BACKGROUND OF THE INVENTION

This invention relates to a four-stroke cycle engine unit to be incorporated in a portable working machine, and more particularly, to a valve drive mechanism of a four-stroke cycle engine unit for driving an exhaust and intake valves of the engine unit.

A portable working machine such as a lawn mower, a trimmer and a chain-saw is equipped with an internal combustion engine unit. In such a portable working machine, it is required for the engine unit to have a relatively compact structure and light weight because such a working machine is operated by hands of an operator and also required to be revolved with high rotation speed. It would also be better to be manufactured with a cheap cost. Such requirements may be satisfied by incorporating a two-stroke cycle engine in the machine.

In comparison of such a two-stroke cycle engine unit with a four-stroke cycle engine unit, the latter engine unit generates noise lower than that of the former engine unit and generates relatively clean exhaust gas, and the latter engine unit is operated with a reduced fuel consumption. In these points, the latter engine unit may be superior to the former engine unit, but the former engine unit can be constructed to be compact with light weight and driven with high speed. Because of such disadvantages, the four-stroke cycle engine unit is not suitable for the incorporation in the portable working machine such as a lawn mower. Namely, the four-stroke cycle engine unit has a size larger than that of the two-stroke cycle engine, which is a significant disadvantage for the portable working machine.

SUMMARY OF THE INVENTION

Accordingly, an object of this invention is to substantially eliminate defects or drawbacks encountered in the prior art and to provide a four-stroke cycle engine unit constructed to be compact with light weight.

Another object of this invention is to provide a four-stroke cycle engine unit provided with an improved valve drive mechanism having an improved structures of lifters, push rods, rocker arms and cam assembly in association with the exhaust and intake valves of the engine unit for making compact and light the same.

A further object of this invention is to provide a working machine equipped with a four-stroke cycle engine unit having an improved structure capable of making compact and light the whole structure of the working machine.

These and other objects can be achieved according to this invention by providing a four-stroke cycle engine of the type comprising an outer casing, a piston-cylinder assembly disposed in the casing and provided with a cylinder and a piston reciprocally moved in the cylinder, a crank shaft rotatably driven by the reciprocal movement of the piston, an exhaust valve, an intake valve, and a valve drive mechanism for driving the exhaust and intake valves, the valve drive mechanism comprising:

a crank gear assembly mounted onto the crank shaft so as to be rotated in accordance with rotation of the crank shaft;

a cam shaft;

a cam gear assembly mounted on the cam shaft and meshed with the crank gear assembly;

a cam assembly mounted onto the cam gear assembly so as to be rotated in accordance with rotation of the cam gear assembly;

a lifter assembly comprising a pair of first and second lifters mounted on a lifter axis portion positioned in parallel to the crank shaft, the lifters being rocked in accordance with rotation of the cam assembly, the lifter axis portion and the cam shaft being positioned in a plane including the crank shaft and a center line of the cylinder of the piston-cylinder assembly;

a pair of first and second push rods lifted up and lowered in accordance with rocking motions of the first and second lifters, respectively; and a pair of first and second rocker arms operated in association with the first and second push rods, the first rocker arm being operatively connected to the exhaust valve so as to carry out open-close operation thereof and the second rocker arm being operatively connected to the intake valve so as to carry out open-close operation thereof.

In preferred embodiments, the cam assembly comprises one cam member, and the first and second lifters are provided with end portions abutting against the cam member to be rockable, the cam member having an outer contour including a maximum lift point and bilateral outer peripheral cam surfaces, on lifting and lowering sides of the first and second rods, which are symmetric with the maximum lift point being a center of the symmetry, and the first and second lifters have contacting surfaces contacting an outer periphery of the cam member and contact points contacting the first and second push rods, the both contact points being arranged symmetrically with respect to the lifter axis portion.

The first and second lifters may be bent so that the contact points of the lifters contacting the first and second push rods lie on the same plane normal to an axial direction of the lifter axis portion. The first and second lifters may be made straight so that the contact points of the lifters contacting the first and second push rods lie respectively on a first and a second planes being in parallel to each other and normal to an axial direction of the lifter axis portion.

The cam gear assembly and the cam assembly are integrally formed by means of sintered alloy.

The lifter axis portion is comprised of a pair of first and second axes or pins onto which the first and second lifters are rockably mounted, respectively, and positioned in the same plane perpendicular to the lifter axis portion.

The first and second push rods may be arranged so as to cross with each other and the exhaust valve and the intake valve are arranged with an angular difference therebetween.

The four-stroke cycle engine unit can be provided for a portable type working machine such as a lawn mower and a chain saw.

According to the four-stroke cycle engine unit of the structure described above, the arrangement or alignment of the various members and elements are improved so as to reduce the length of the engine unit in the axial direction of the crank shaft, thus making compact and light weight the engine unit.

The engine unit is provided with the valve drive mechanism having the lifters, push rods, the rocker arms and the cam assemblies, for transmitting the power from the crank shaft to the exhaust valve and the intake valve, which are improved in their structures for making compact the engine unit and hence the portable working machine into which the engine unit is incorporated.

BRIEF DESCRIPTION OF THE DRAWINGS

For a better understanding of this invention and to show how the same is carried out, reference is first made, by way of preferred embodiments, to the accompanying drawings, in which:

FIGS. 1 to 11 represent a first embodiment according to this invention, in which:

FIG. 1 is a illustration of a lawn mower as one kind of a portable working machine, to which an engine unit of this invention is applicable, when used by an operator;

FIG. 2 is an elevational section of the engine unit of the lawn mower of FIG. 1;

FIG. 3 is a front view of a valve drive mechanism of the engine unit shown in FIG. 2;

FIG. 4 is a plan view of a lifter assembly of FIG. 3;

FIG. 5 is a view for the explanatory of the operation of a cam mechanism related to a first lifter of the lifter assembly;

FIG. 6 is also a view of the explanatory of the operation of a cam mechanism related to a second lifter of the lifter assembly;

FIG. 8 is a chart for showing the opening-closing timings of the intake valve and the exhaust valve;

FIG. 9 is a sectional view taken along the line IX—IX of FIG. 2;

FIG. 10 is a sectional view taken along the line X—X of FIG. 2;

FIG. 11 is a sectional view taken along the line XI—XI of FIG. 9;

FIGS. 13 to 15 are views representing a third embodiment of an engine unit according to this invention, in which:

FIG. 13 is a sectional view of a portion of a valve drive mechanism;

FIG. 14 is a view similar to FIG. 13 showing a modification thereof;

FIGS. 17 to 19 represent a fifth embodiment according to this invention, in which:

FIG. 18 is a view showing a rod operated in association with the lifter;

FIG. 19 is a partial sectional view of a cylinder head of a cylinder assembly of the engine unit;

FIGS. 20 to 23 represent a sixth embodiment according to this invention, in which:

FIG. 20A is a schematic sectional illustration of members in association with a rocker arm;

FIGS. 20B and 20C are sectional views taken along the line XX—XX in FIG. 20A;

FIGS. 21 and 22 are front views of modifications of the valve drive mechanism, partially broken away, according to this invention;

FIG. 23 is a plan view of a lifter assembly of the valve drive mechanism of FIG. 22;

FIGS. 24 to 27 represent a seventh embodiment according to this invention, in which:

FIG. 24 is a vertical elevational section of an engine unit;

FIG. 25 is a perspective view in an enlarged scale of a gear member incorporated in the engine unit of FIG. 24;

FIGS. 28 to 37 represent an eighth embodiment according to this invention, in which:

FIG. 28 is a perspective view of a portable chain saw in condition for use to which the eighth embodiment of this invention is applied;

FIG. 29 is a front view of a valve drive mechanism incorporated in the chain saw of FIG. 28;

FIG. 30 is a view of an intake valve as viewed from an arrow XXX—XXX of FIG. 29;

FIG. 31 is a plan view of a lifter assembly of the valve drive mechanism of FIG. 29;

FIG. 32 is a sectional view of the engine unit for showing the interior structure thereof;

FIG. 33 is a sectional view of a modification of the valve drive mechanism of FIG. 29;

FIG. 34 is a plan view of a lifter assembly of the valve drive mechanism of FIG. 33;

FIG. 35 is a front view of another modification of the valve drive mechanism of FIG. 29;

FIG. 36 is a sectional view of a further modification of the valve drive mechanism; and FIG. 37 is a front view of a cam of the valve drive mechanism of FIG. 36;

FIGS. 38 to 41 represent conventional art, in which:

FIG. 38 is an elevational section of a conventional engine unit for a portable working machine;

FIG. 39 is a front view of a portion of FIG. 38;

FIG. 40 is an illustrated front view of a cam mechanism in the prior art; and FIG. 41 is a graph representing the relationship between lift speed and cam shaft rotation angle in connection with FIG. 40.

DESCRIPTION OF THE PREFERRED EMBODIMENTS

First, for a better understanding of this invention, a conventional art will be described hereunder with reference to FIGS. 38 to 41.

Figure 38:
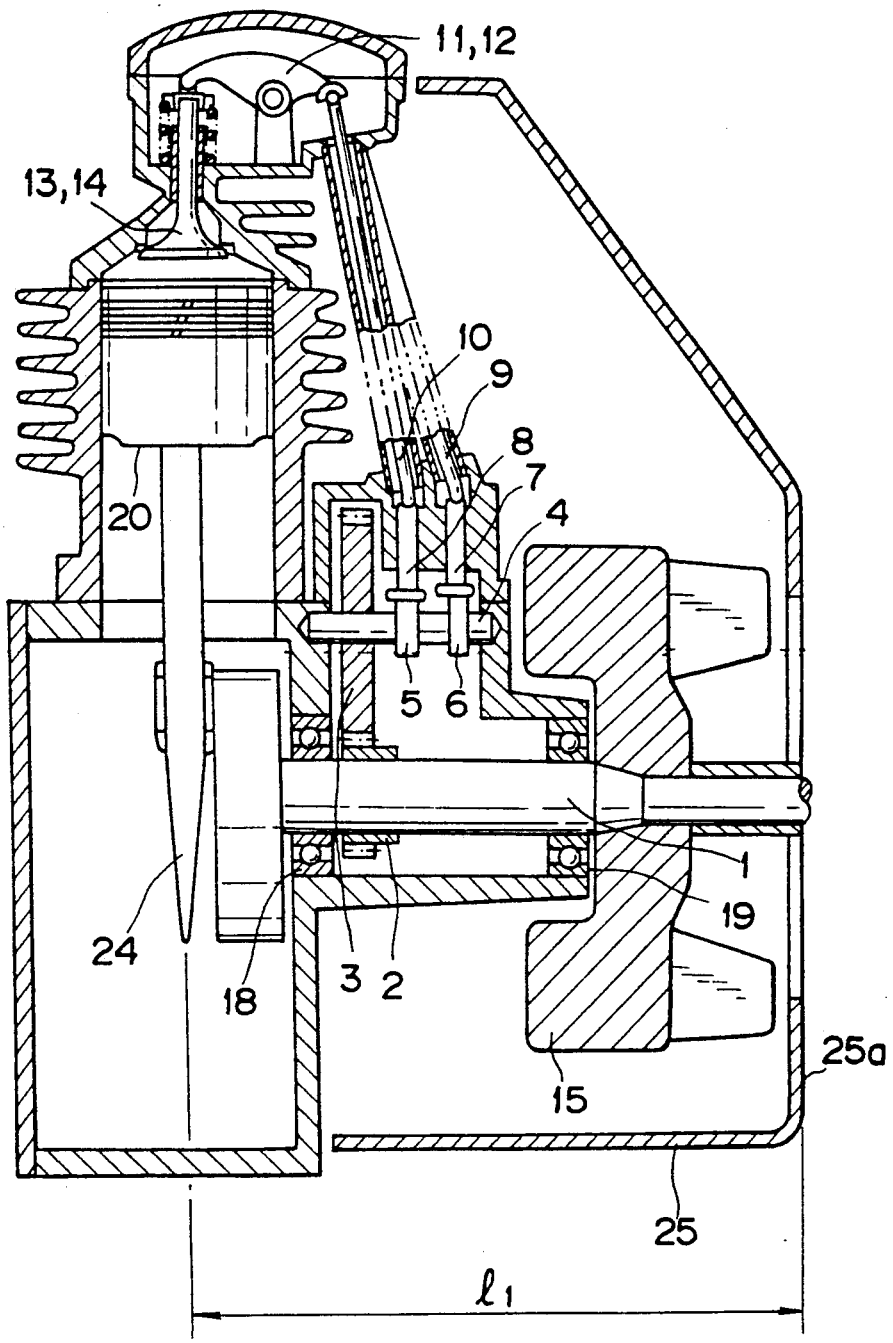
FIG. 38 PRIOR ART
Figure 39:
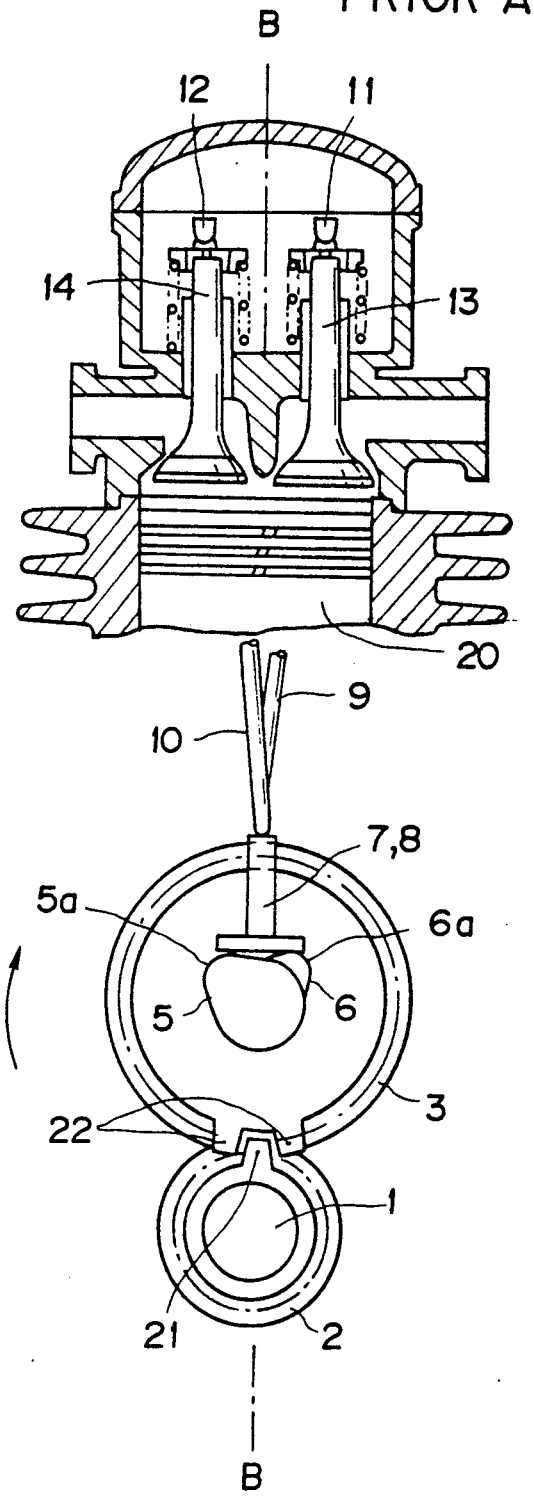
FIG. 39 PRIOR ART

In a conventional four-stroke cycle engine unit, as shown in FIGS. 38 and 39, an engine unit includes a crank shaft 1, which is rotatably supported by bearings 18 and 19, to which a crank gear 2 is mounted. When the crank gear 2 is rotated, a cam gear 3 mounted to a cam shaft 4 and meshed with the crank gear 2 is also rotated in a direction reverse to the rotation of the crank gear 2. Onto the cam shaft 4 are mounted an air inlet cam 5 and an exhaust cam 6, and an air intake valve 13 and an exhaust valve 14 are operated in accordance with the rotations of these cams 5 and 6 through tappets 7, 8, push rods 9, 10 and rocker arms 11, 12, respectively, in this order. A fly wheel 15 is mounted to one end of the crank shaft 1 to transmit a power to a power driving system through a clutch, not shown.

In a case where such a four-stroke cycle engine unit is incorporated in a portable working machine to drive the same, it is desired to reduce total size and weight of the engine unit as much as possible and, hence, the whole structure of the portable working machine, particularly, by reducing an axial distance from the crank shaft 1 and the fly wheel 15. For this purpose, in the conventional technology, the intake valve 13 and the exhaust valve 14 are arranged at portions, as shown in FIG. 38, in a plane substantially normal to the crank shaft 1, vertical direction as viewed. In such arrangement, however, there requires some space or size for incorporating the tappets 7 and 8, which results in the increasing of a length $l_1$ in FIG. 38 between a piston rod 24 and an outer surface of a casing 25 of the working machine, thus being difficult to make compact the engine unit.

Referring to FIG. 39, which shows a piston 20 displaced at its upper dead point, the top point 5*a* of the air inlet cam 5 and the top point 6*a* of the exhaust cam 6 have predetermined angles with respect to a piston motion axis B—B in accordance with a design value of the valves 13 and 14 at their opening-closing timings. Accordingly, it is required to prevent the cam gear 3, the crank shaft 1 and the crank gear 2 from being erroneously engaged, and for example, as shown in FIG. 39, identification marks 21 and 22 are marked to the crank gear 2 and the cam gear 3, respectively, for avoiding such erroneous engagement. However, since the identification marks 21 and 22 are disposed with predetermined angles with respect to the top points of the cams 5 and 6 for the cam shaft 4 and to an extending direction of a crank pin for the crank shaft 1, position indexing workings are needed at working and manufacturing times of the working machine, resulting in cost increasing. Particularly, at the assembling time, in a case where the gearing condition or position of the crank gear 2 and the cam gear 3 is not visually observed, it is extremely difficult to precisely assembling the engine unit.

Figure 41:
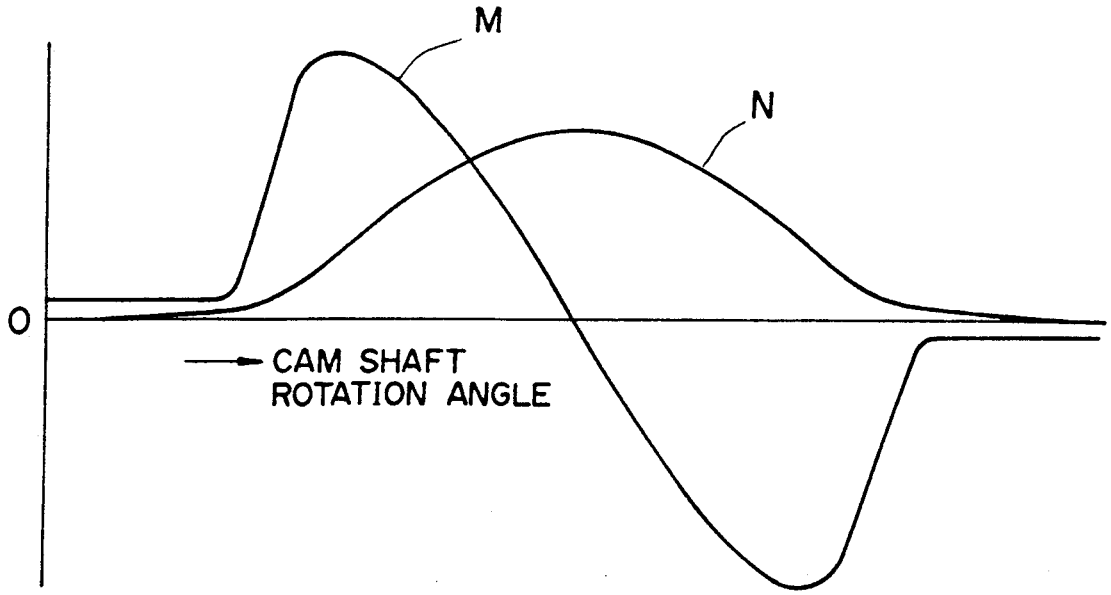
FIG. 41 PRIOR ART

FIGS. 41 and 42 show another example of conventional art for the explanatory of the principle of an operation of a cam mechanism composed of a cam 23 and elevatable tappets 7 and 7 driven by the cam 23.

Figure 40:
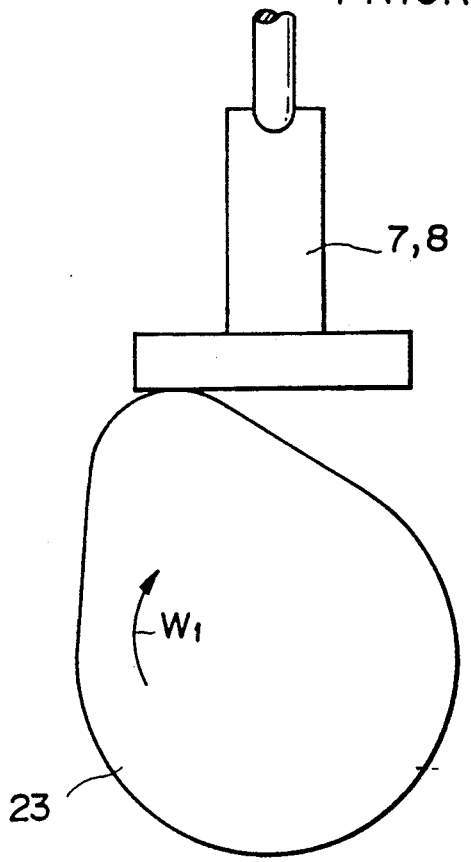
FIG. 40 PRIOR ART

Referring to FIGS. 41 and 42, the cam 23, to be rotated in a direction indicated by an arrow $W_1$, has a symmetric structure on the tappet lifting and lowering sides, and a lifting speed curve M is shown to be bilaterally symmetric with the maximum point of the lift N being the center of the symmetry. Particularly, with the engine unit of the portable working machine, it is necessary to increase the rotation speed of the crank shaft to thereby increase an output power per weight of the engine. For this purpose, it will be required to make small the valve opening speed of the exhaust valve to effectively utilize the pressure of combustion gas to a value of the lower dead point of the piston and also to make large the valve closing speed of the exhaust valve for making large an innertia effect at the valve opening time of the intake valve. It is also required to make large the valve opening speed of the intake valve to effectively unilize an innertia effect at the valve closing time of the exhaust valve and also to make small the valve closing speed of the intake valve for preventing a heated exhaust gas form spitting to an operator. However, it is difficult to fully attain such effects as described above in the case of unilizing only one cam 23 as shown in FIGS. 40 and 41. Accordingly, in the conventional technology, as shown in FIGS. 38 and 39, independent cams having different shapes are disposed for driving the intake valve and the exhaust valve, respectively. Such arrangement requires much cost and involves a problem of increasing the length $l_1$ of the engine unit, thus being difficult to make compact the engine unit.

This invention conceived for solving the above problems encountered in the prior art will be described hereunder with reference to the preferred embodiments.

Figure 1:
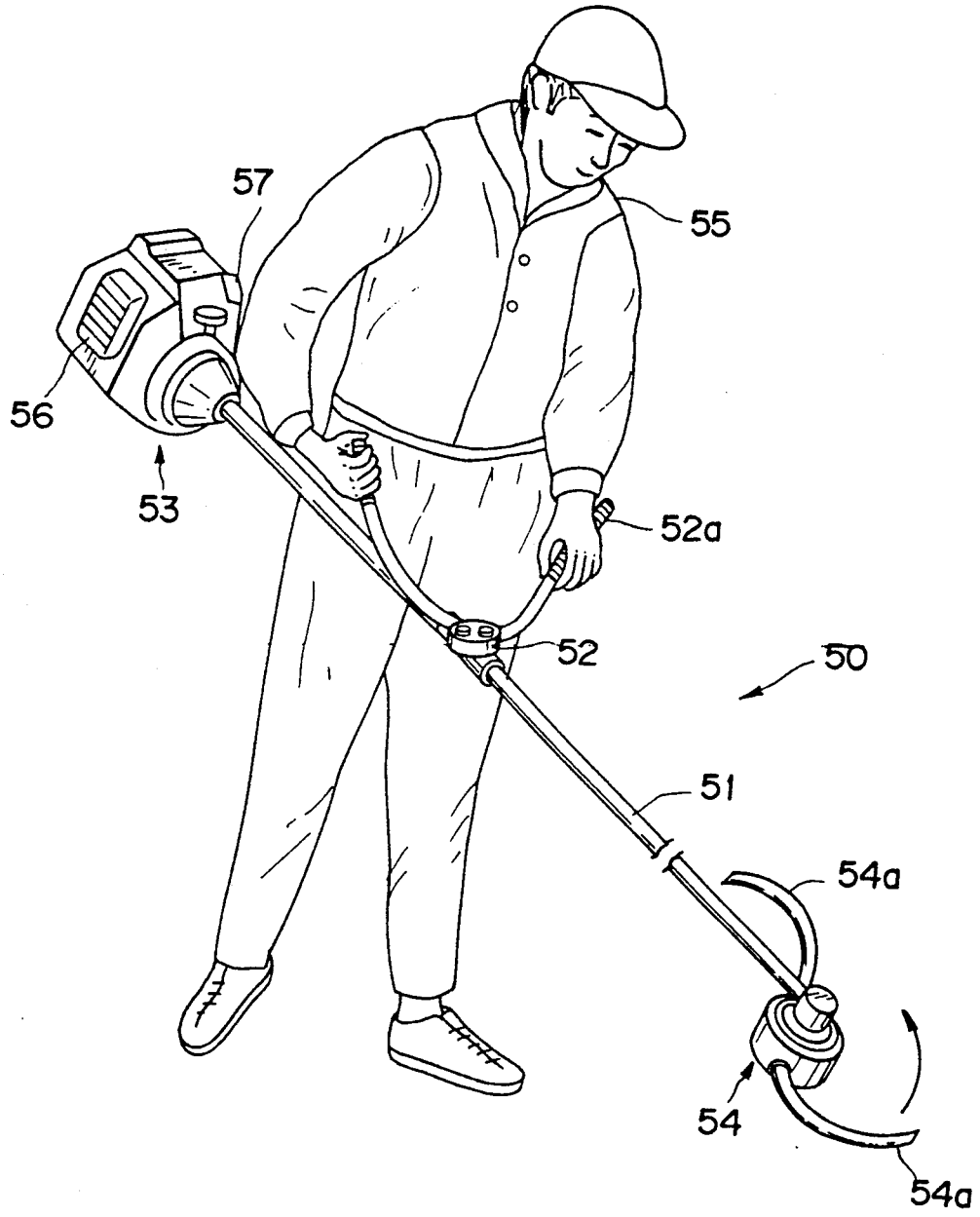

A first embodiment is described with reference to FIGS. 1 to 11, which is applied to a portable working machine such as a lawn mower 50 such as shown in FIG. 1.

The lawn mower 50 shown in FIG. 1 generally comprises a long shaft-like power transmission member 51, an operating portion 52 on which a handle 52*a* is provided, an engine unit 53 secured to one end of the transmission shaft member 51 and a working device 54 secured to the other end thereof. The power generated by the driving of the engine unit 53 is transmitted to the working device 54 including a working portion such as a lawn mower blade 54*a* through the power transmission shaft member 51. The shaft member 51 is composed of an outer pipe and an inner steel wire or rod which is connected to the crank shaft, i.e. output shaft, of the engine unit through a clutch means. The steel rod is rotatably supported in the outer pipe and transmits the power to the working device 54 and, hence, the lawn mower blade 54*a*.

When the working machine 50 is actually used, the working machine 50 is supported by an operator 55 who generally stands on the right side of the engine unit 53 as viewed in FIG. 1 and holds or grips the handle 52*a*. In consideration of such general attitude of the working condition, an exhaust gas muffler 56 for preventing the operator from being suffered from the spitting of the heated exhaust gas is provided on the engine unit 53 on the side apart from the operator, and an air intake port 57 of a carburetor is formed on the side near the operator.

Figure 2:
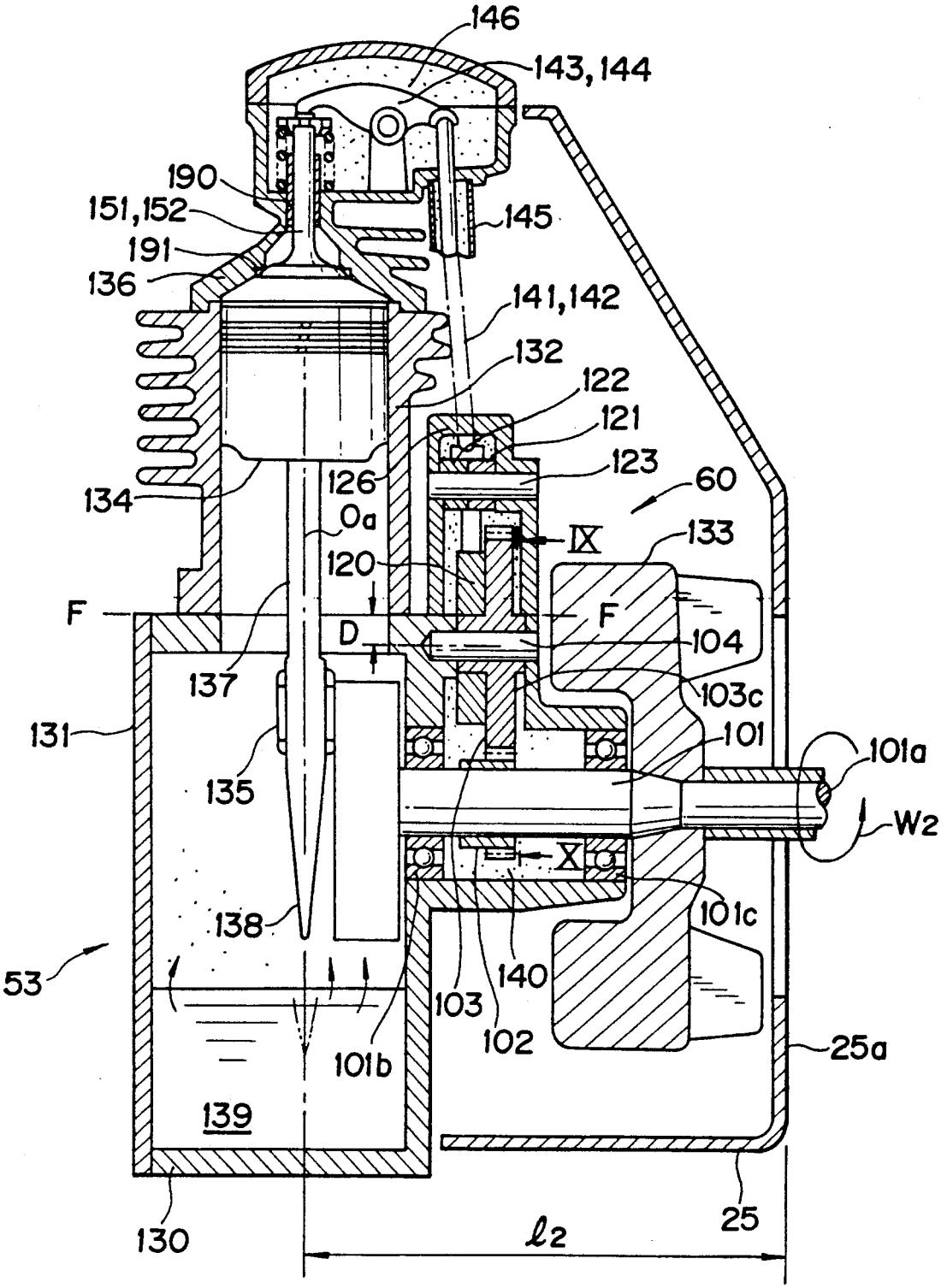
Figure 3:
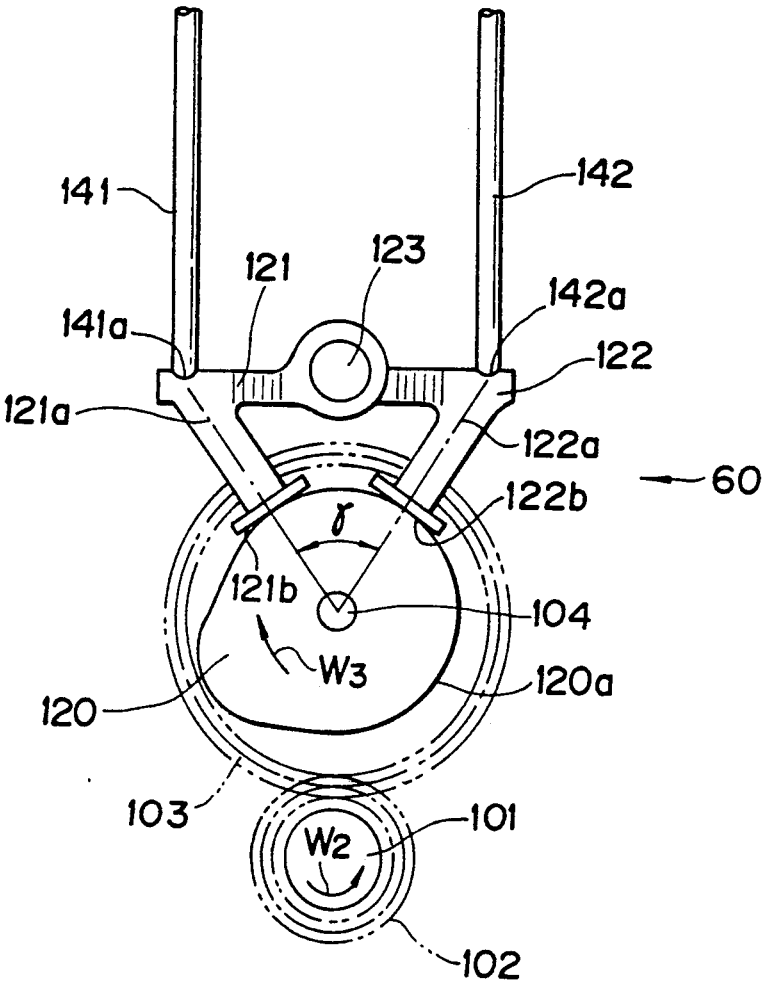
Figure 4:
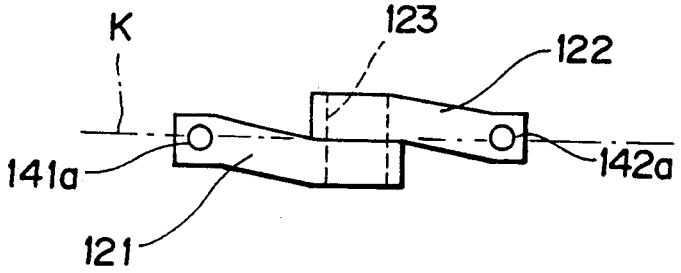

As shown in FIGS. 2 to 4, the portable type engine unit 53 for the working machine 50 is equipped with a valve drive mechanism 60 disposed in a main body 131 of the engine unit 53 which constitutes a crank case 130. The engine unit 53 includes a crank shaft 101 having one end on which is integrally formed a power output shaft 101*a* which is connected to the power transmission shaft 51. On the outer periphery of the crank shaft 101 is mounted a crank shaft gear 102 which is meshed with a cam gear 103, and accordingly, when the crank shaft gear 102 is rotated, the cam gear 103 is followed and rotated in a direction reverse to the rotation of the crank gear 102.

The cam gear 103 is mounted to a cam shaft 104 rotatably supported to the crank case 130 of the main body 131 of the engine unit 53, and one cam 120 is secured to the cam gear 103. As shown in FIG. 3, a lifter assembly comprising a pair of rockable or swingable lifters 121 and 122 are disposed so as to abut against the cam 120 at their one ends, and the lifters 121 and 122 are swingable about a common lifter axis 123 such as a pin through which these two lifters are operatively coupled. The lifter axis 123 and the cam shaft 104 are positioned in a plane, that is, on the drawing sheet surface of FIG. 2, including a crank shaft 101 and the cylinder center line O*a*. The lifter axis 123, the cam shaft 104 and the crank shaft 101 are arranged in parallel to each other.

One 121 of these lifters is connected to a push rod 141 for the exhaust valve and the other one 122 of the lifters is connected to a push rod 142 for the intake valve, the push rods 141 and 142 being moved in a reciprocal manner. These lifters 121 and 122 are formed of the same material and disposed so as to face with each other, and as shown in FIG. 4 from the upper side, these lifters are bent to the same extent such that the lefthand end of the lifter 121 is bent upwardly as viewed in FIG. 4 and the righthand end of the lifter 122 is bent downwardly also as viewed in FIG. 4. Accordingly, a contact point 141*a* formed at the lefthand end of the lifter 121 contacting the push rod 141 and a contact point 142*a* formed at the righthand end of the lifter 122 contacting the push rod 142 lie on the same plane K extending to be normal to the lifter axis 123. Further, the central axes 121*a* and 122*a* of these lifters 121 and 122 cross at the central point of the cam shaft 104 at an angle of $\gamma$ when the lifters abut against the cam circumferential portion 120*a* of the cam 120. The lifters 121 and 122 have free ends formed as flat plate-like portions 121*b* and 122*b* which contact the cam circumferential portions of the cam 120 and the contact points 141*a* and 142*a* of the push rods 141 and 142 are positioned symmetrically with respect to the lifter axis 123 as shown in FIG. 3.

As described above, the exhaust valve 151 and the intake valve 152 shown in FIG. 2 are operated by one cam 120 through a pair of lifters and the corresponding push rods. The valve drive mechanism 60 thus constructed by the lifters 121, 122, the cam gear 103 and the cam 120 is accommodated in a valve mechanism accommodation chamber 126 fastened, by means of bolts, for example, to the crank case 130.

The reciprocal push rods 141 and 142 for the exhaust valve and the intake valve are respectively coupled to a pair of rocker arms 143 and 144 swingably provided in a valve chamber 146 formed at an upper portion of the main body 131 of the engine unit. These rocker arms 143 and 144 are also respectively connected to the exhaust valve 151 and the intake valve 152 disposed to the cylinder head 136 positioned at the upper portion of the cylinder assembly 132 of the engine main body 131, thereby these valves 151 and 152 being operated to be opened or closed in accordance with the rocking motions of the rocker arms 143 and 144.

The crank shaft 101 is supported to be rotatable by the bearings 101*a* and 101*b* and has a portion, on the side of the output shaft 101*a*, to which a fly wheel 133 is mounted so that the engine power is transmitted to the power transmission shaft 51 as the rotational force from the output shaft 101*a* through a clutch, not shown.

Accordingly, when the crank shaft 101 is rotated, by the movement of the piston 134 reciprocally displaced in the cylinder 132, in a counterclockwise direction $W_2$ (when the engine unit 53 is viewed from the output shaft side), the cam gear 103 meshed with the crank gear 102 is rotated in a clockwise direction $W_3$ as shown in FIG. 3. According to the rotation of the cam gear 103, the cam 102 secured to the cam gear 103 is also rotated in the clockwise direction $W_3$. In response to this rotation, one lifter 121 of the paired lifters is first rocked in the clockwise direction and the push rod 141 for the exhaust valve 151 is moved upwardly as viewed to thereby open the exhaust valve 151 through the motion of the rocker arm 143. Then the cam 120 is further rotated, the contacting portion of the lifter 121 moves over the protruded portion 120*b* of the cam 120 and, from this time, the lifter 121 is rocked counterclockwisely and the exhaust valve 151 is then operated to be closed through the motions of the push rod 141 and the rocker arm 143. Just before the closing of the exhaust valve 151, the intake valve 152 is operated to be opened. Namely, during the further rotation of the cam 120, the other lifter 122 contacting the cam surface of the cam 120 is rocked in the counterclockwise direction and the push rod 142 for the intake valve 152 is moved upwardly to thereby open the intake valve 152 through the motion of the rocker arm 144. The exhaust valve 151 is then closed. Next, when the cam 120 is still further rotated, the lifter 122 is clockwisely rocked and the intake valve 152 is operated to be closed through the motions of the push rod 142 and the rocker arm 144. When the intake valve 152 has been closed, one operation cycle of the exhaust and intake valves have been completed.

Figure 5:
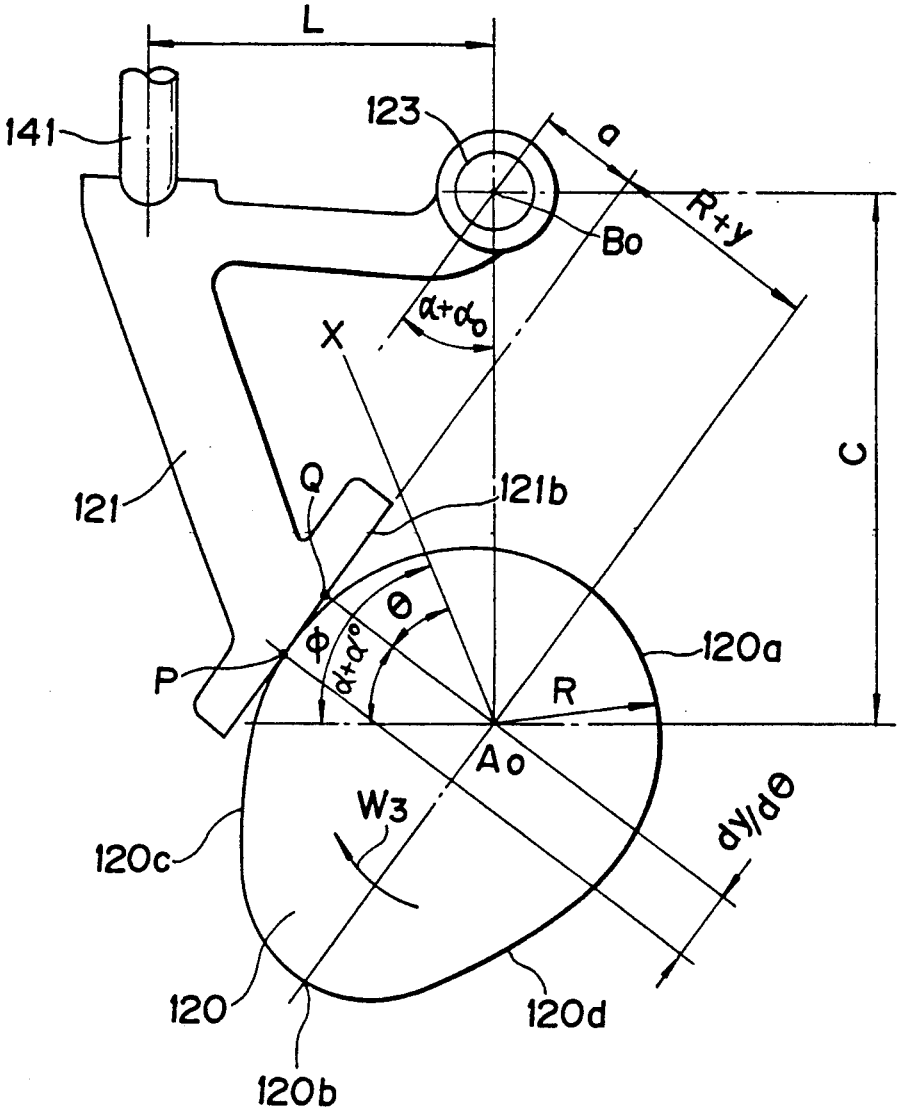
Figure 6:
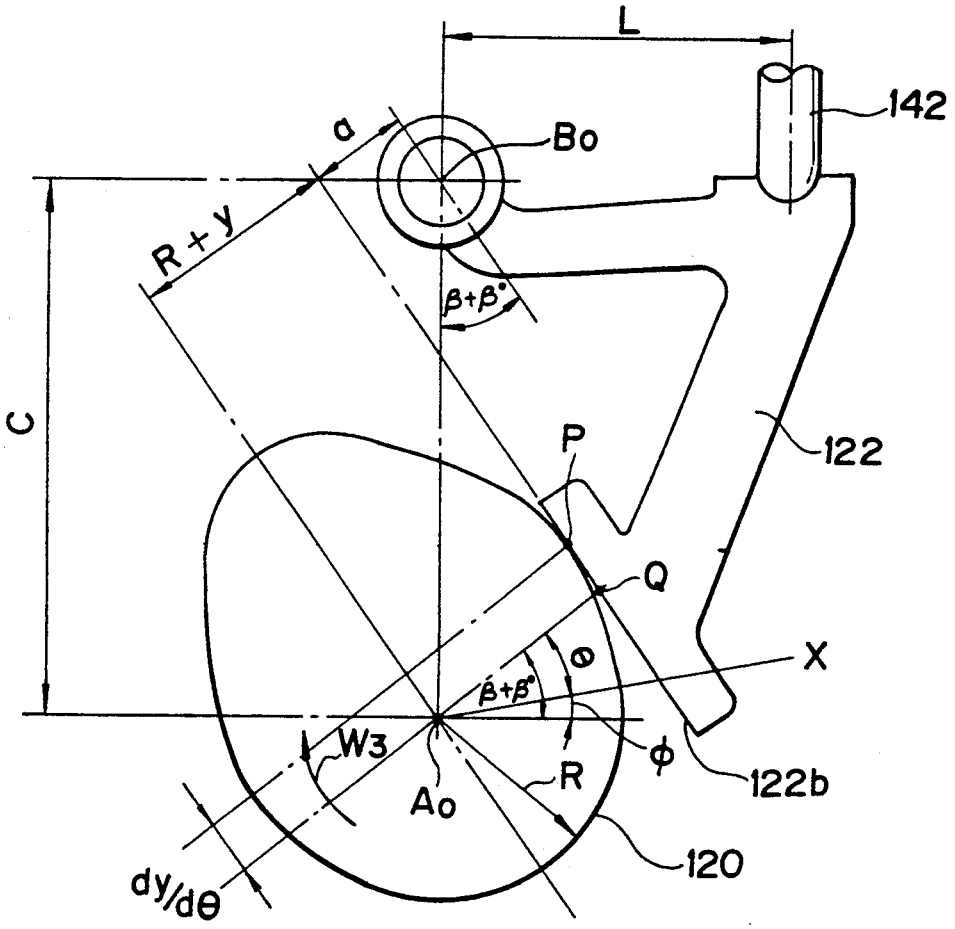

As shown in FIG. 5 or 6, the cam 120 has an outer contour composed of the circular portion 120*a*, the maximumly protruded portion 120*b* and the intermediate reduced diameter portions 120*c* and 120*d* with symmetrical shape.

As described above, according to this embodiment, since the swingable lifters 121 and 122 are rocked by one cam 120, the length of the cam 120 in the axial direction of the crank shaft 101 is made short such as the length $l_2$ shown in FIG. 2 shorter than the length $l_1$ in the conventional engine unit, and the weight is also reduced because of the location of one cam 120. Furthermore, in the conventional arrangement, it is required to have a wide space to dispose the tappets, but in the arrangement of the present embodiment, the space can be also reduced because of the location of only one cam.

The condition that the engine unit equipped with the valve drive mechanism 60 of the structure described hereinbefore is incorporated into the portable working machine such as the lawn mower 50, is shown in FIG. 1. When the crank shaft 101 is rotated, the exhaust valve 151 and the intake valve 152 are opened and closed with the predetermined intervals and timings, and the output power of the engine unit is transmitted to the working device 54 through the power transmission shaft member 51. In this case, the valve drive mechanism 60 is disposed on the side of the output shaft 101*a* of the engine unit 53, and when the engine unit 53 is viewed from the working device 54, the exhaust valve 151 is positioned on the lefthand side and the intake valve 152 is positioned on the righthand side. Moreover, the crank shaft 101 is rotated in the counterclockwise direction and the cam shaft 104 is rotated in the clockwise direction, so that the exhaust side is positioned apart from the operator side when he has the handle of the working machine 50, whereby the operator is prevented from being suffered from the spitting of the hot exhaust gas.

The operations of the cam 120 and the swingable or rockable lifters 121 and 122 will be described further in detail hereunder with reference to FIGS. 5 to 7.

Referring to FIG. 5, the cam 120 has a symmetric outer configuration. That is, the outer peripheral surfaces 120*c* and 120*d* of the rising side and lowering side of the respective push rods 141 and 142 are formed symmetrically with respect to the maximum lift point, i.e. the most protruded portion 120b of the cam 120. The cam 120 rotates about the rotation center $A_0$ being the center of the cam shaft 104. The paired lifters 121 and 122 are rockable about the center $B_0$ of the rocking motion of the lifter axis 123.

According to the cam structure described above, the lift curves of the exhaust valve 151 and the intake valve 152 can be made different.

Namely, referring to FIGS. 5 and 6, providing that the radius of the circular portion 120a of the cam 120 is R, the rocking angles of the lifters 121 and 122 are $\alpha$ and $\beta$, and the distance between the rocking motion center $B_0$ of the lifters 121 and 122 and the push rods 141 and 142 are L, respectively, the lift amounts of the push rods 141 and 142 will be expressed as distance ($L\times\alpha$) and ($L\times\beta$). Symbol X denotes an axis of coordinates secured to the cam 120 and symbol $\theta$ denotes a relative angle to the axis X at a time when the cam 120 and the contacting surfaces 121b and 122b of the lifters 121 and 122 move on the outer contour of the cam 120.

In this case, the angle $\theta$ is not equal to the rotational angle of the cam shaft 104 and this rotational angle becomes $\phi$. Under this condition, a distance between contacting points P and Q to the cam 120 (Q: contacting point to the circular portion 120a of the cam 120) is expressed as $dy/d\theta$ due to a formula of structural theory, and supposing that the angle $\alpha$ (or $\beta$) of the contacting surface 121b (or 122b) contacts the circular portion of the cam 120 is $\alpha_0$ (or $\beta_0$) and the distance between the rocking center $B_0$ of the rockable lifters 121, 122 and the rotation center $B_0$ of the cam 120 is C, the following equations will be obtained.

$$C\times\sin(\alpha+\alpha_0)=(R+y+a)$$

$$\alpha+\alpha_0=\sin^{-1}[(R+y+a)/C]$$

$$\phi=\theta+(\alpha+\alpha_0)$$

From these equations, the following equation is obtained.

$$d\alpha/d\phi=(dy/d\theta)/[dy/d\theta+C\cos(\alpha+\alpha_0)]$$

Accordingly, since the lifting speed of the push rod 141 for the exhaust valve is expressed as $L\cdot dy/d\theta$, the lifting speed $M_1$ of the push rod 141 at the lift-up operation time is made smaller than that at the lift-down (lowering) operation time even if the absolute value of $dy/d\theta$ is the same at both operation times. The reason resides in that the value of $dy/d\theta$ becomes negative at the lift-up operation time, whereas it becomes negative at the lowering operation time.

Figure 7A:
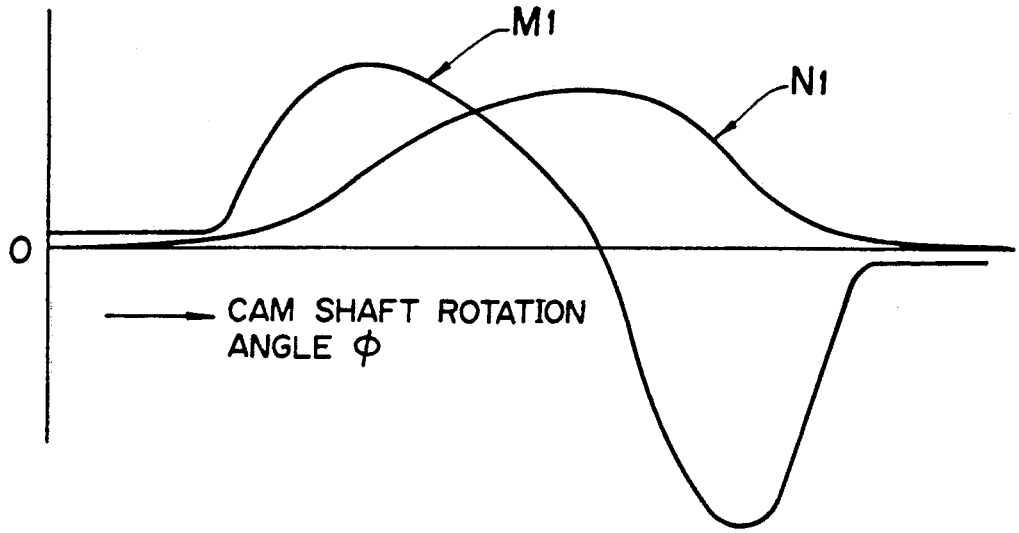
FIGS. 7A and 7B are graphs representing relationships between the cam shaft rotation angle and the lifting speed on the intake side and the exhaust side.

As described above, according to the present embodiment, in which outer peripheral configurations of the cam (120) portions acting at the push rod lift-up and lowering operation times are symmetrically formed, the lift-up speed of the push rod 141 for the exhaust valve is made lower, as shown in FIG. 7A, than the lowering speed, thus attaining a characteristic feature superior to that of the conventional mechanism.

Further, regarding the push rod 142 for the intake valve shown in FIG. 6, the rocking direction of the lifter 122 is made reverse to that of the lifter 121 in association with the push rod 141 for the exhaust valve. Namely, the following equations will be obtained.

$$C\times\sin(\beta+\beta_0)=(R+y+a)$$

$$\beta+\beta_0=\sin^{-1}[(R+y+a)/C]$$

$$\phi=\theta-(\beta+\beta_0)$$

From these equations, the following equation is obtained.

$$d\beta/d\phi=(dy/d\theta)/[-dy/d\theta+C\times\cos(\beta+\beta_0)]$$

Accordingly, since the lifting speed $M_2$ (FIG. 7B) of the push rod 142 for the intake valve at the lift-up time is made higher than that at the lift-down (lowering) time even if the absolute value of $dy/d\phi$ is the same at both times. Namely, according to the present embodiment, in which the cam (120) portions acting at the push rod lift-up and lowering times are symmetrically formed, the lift-up speed of the push rod 142 for the intake valve is made higher, as shown in FIG. 7B, than the lowering speed thereof, whereby the rotating speed of the crank shaft 101 increases and the output power is hence made large.

Figure 7B:
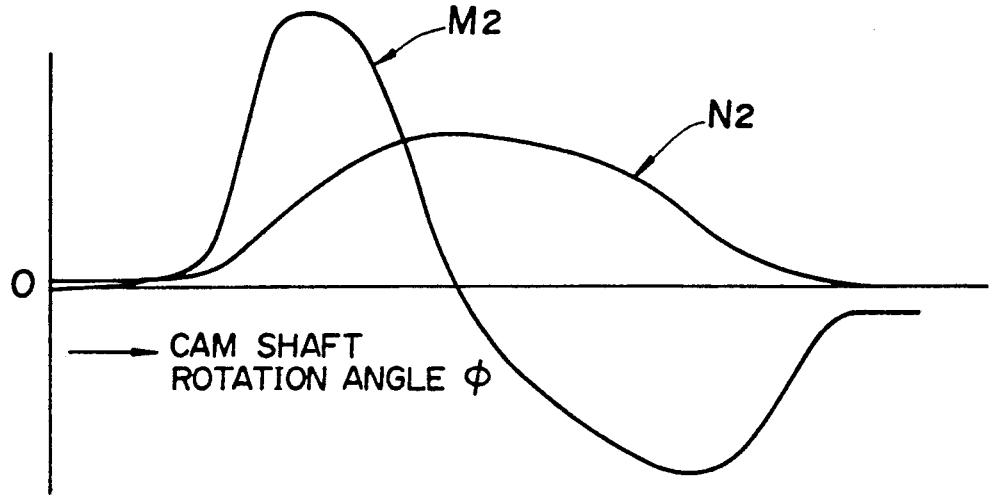

Reference characters $N_1$ and $N_2$ in FIGS. 7A and 7B denote the lift amounts.

According to various experimental tests, with respect to engine units of portable working machines, it was found to be desirable that the ratio of the lift-up speed of the push rod 141 (and 142) with respect to the lowering speed thereof is 120 to 170% on the exhaust side but is 83 to 58% on the intake side.

Figure 8:
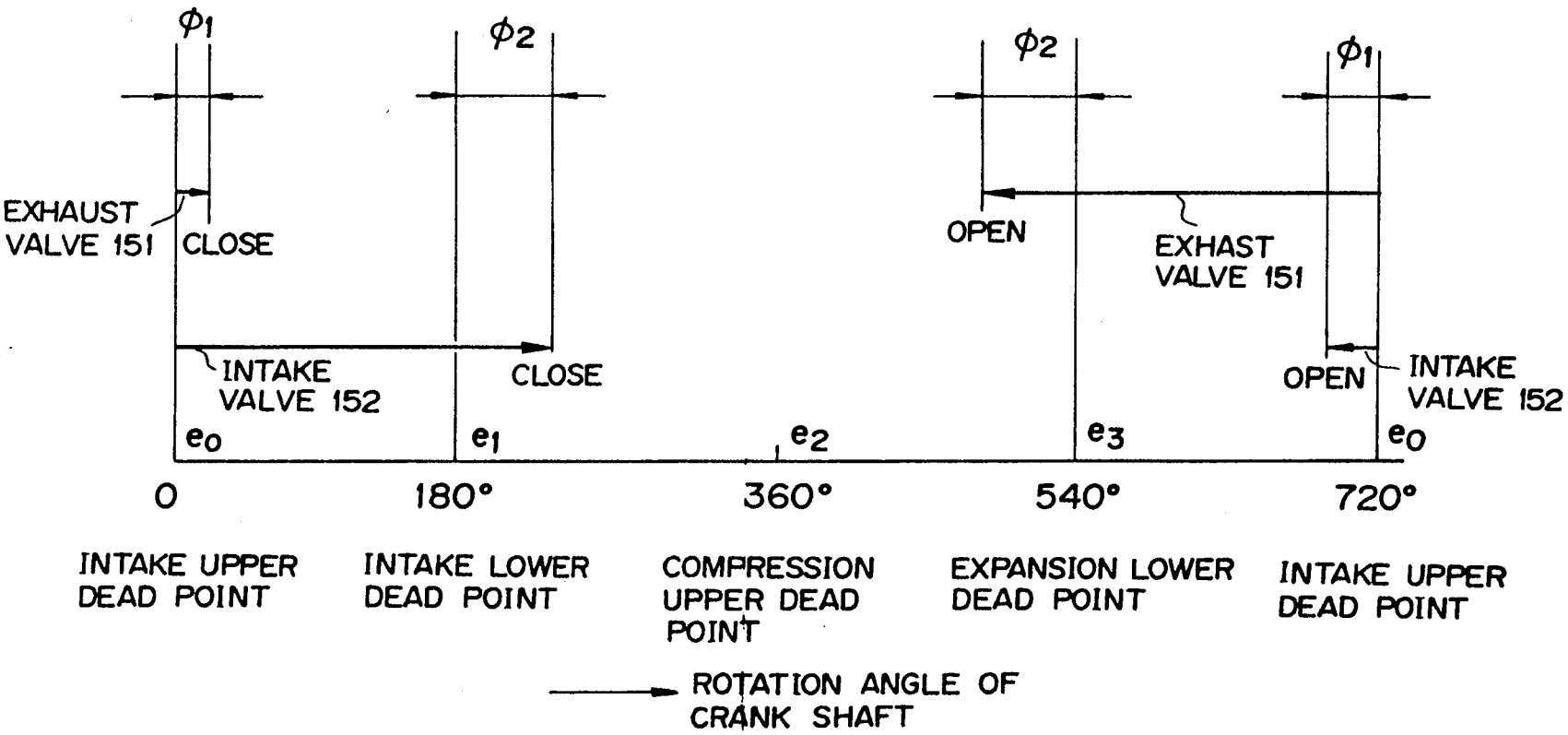

FIG. 8 is a time chart showing valve opening-closing timings of the exhaust valve 151 and the intake valve 152.

Referring to FIG. 8, the intake valve 152 is opened with an angle $\phi_1$ of 20°, for example, before the sucking upper dead point $e_0$ and closed with an angle $\phi_2$ of 60°, for example, after the sucking lower dead point $e_1$. On the other hand, the exhaust valve 151 is opened with the angle $\phi_2$ of 60°, for example, before the expanding lower dead point and is closed with the angle $\phi_1$ of 20°, for example, after the sucking upper dead point ($\phi_1$ and $\phi_2$: rotating angles of the crank shaft 101).

Since the cam 120 has portions symmetric with each other on the push rod lift-up and lowering sides, the maximum lift timing of the push rod 141 for the exhaust valve is present at a position of the following angle before the sucking upper dead point $e_0$, $$0.5(\phi_1+\phi_2+180)-\phi_1=0.5(180+\phi_2-\phi_1),$$

and the maximum lift timing of the push rod 142 for the intake valve is present at a position of the following angle after the sucking upper dead point $e_0$, $$0.5(\phi_1+\phi_2+180)-\phi_1=0.5(180+\phi_2-\phi_1).$$

Accordingly, the relative angle $\gamma$ (FIG. 3) constituted by the center lines 121a, 122a of the lifters 121, 122 is expressed as $0.5(180+\phi_2-\phi_1)$ in consideration of the rotation angle of the cam 120 being a half ($\frac{1}{2}$) value of that of the crank shaft 101. As referred to the above, the value of the angle $\gamma$ is designed to be of $0.5(180+\phi_2-\phi_1)$, for example, $0.5(180+60-20)°=110°$, and is made equal to the angular difference between the maximum lift timings of the intake and exhaust times in assumption of $\phi_1=20°$ and $\phi_2=60°$, calculated by the valve opening-closing timings. Therefore, the top portion of the cam is positioned towards the central direction of the lifter axis 123, and that is, the line connecting the top portion 120a of the cam 120 with the rotation center $A_0$ of the cam shaft accords with the direction of the piston reciprocal motion, whereby the valve opening-closing timings of both the exhaust and intake valves 151 and 152 can be naturally ensured.

Figure 9:
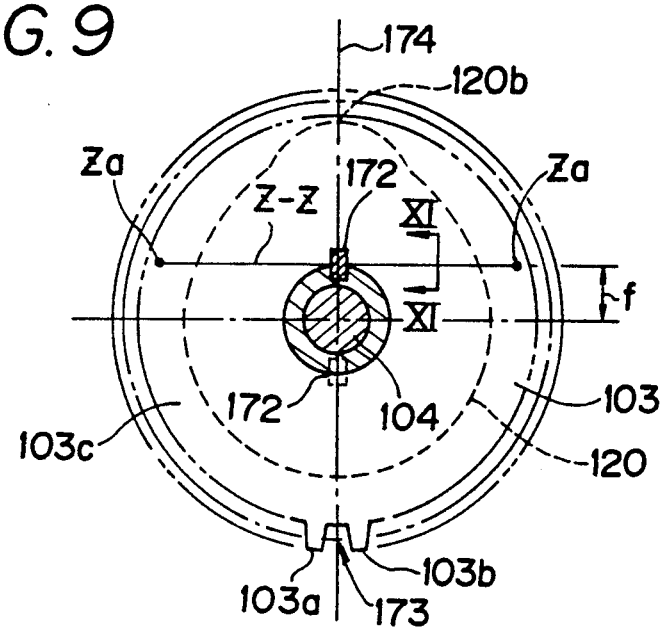

Next, referring to FIGS. 9 to 11, the precise assembling of the crank gear 102 and the cam gear 103 at a time of assembling the engine unit 53 is made in the following manner.

The crank gear 102 is secured to the crank shaft 101 by means of two keys or pins 170 and the cam 120 is secured to the cam gear 103 by means of two keys or pins 172. When the crank shaft 101 is moved to the upper dead point, the keys 170 lie on a line 171 connecting the center of the crank shaft 101 with the center of the crank pin 135. Under this state, the central portion of one gear tooth 102*a* positioned at the top portion of the crank gear 102 also lies on this line 171. Under the state, the keys 172 of the cam gear 103 lie on a line 174 connecting the center of the cam gear 103 with the cam top portion 120*b* of the cam 120, and an intermediate position 173 of two teeth 103*a* and 103*b* adjacent to each other of the cam gear 103 positioned oppositely to the cam top portion 120*b* also lies on the line 174. Since the cam shaft 104 to which the cam gear 103 is secured is rotatably supported to the crank case 130, the positional indexing of the cam gear 103 and the crank gear 102 at the assembling time can be easily made.

A linear identification mark Z—Z for indicating the position of the cam gear 103 is formed in the surface 103*c* of the cam gear 103 on the side of the fly wheel 133 so as to be normal to the line 174. When the crank shaft 101 is positioned to the upper dead point, a distance f between the center of the cam shaft 104 and the identification mark Z—Z is designed to become substantially equal to a distance D between an assembling surface F—F (as shown in FIG. 2) of the cylinder 132 to the crank case 130 and the center of the cam shaft 104 (as shown in FIG. 2). The identification mark Z—Z is formed as a linear groove, but it may be substituted with points Za and Zb formed on the surface 103*c* of the cam gear 103.

Figure 10:
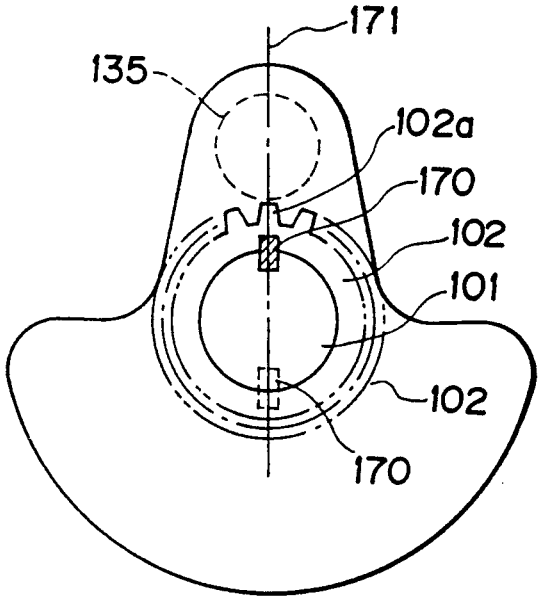
Figure 11:
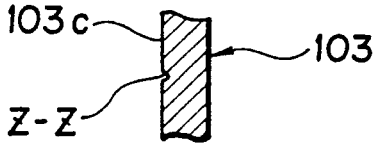

In the case of assembling the gear mechanism of the structure described above, the crank shaft 101 is first rotated to position the piston 134 to the upper dead point of the state shown in FIG. 10, and this operation is usually performed before the assembling of the cylinder head 136, so that the operation can be easily performed. Next, the cam gear 103 is assembled so as to be meshed with the crank gear 102 while the identification mark Z—Z (or points Za and Zb) formed on the surface 103*c* of the cam gear 103 is moved to a portion parallel to or overlapped with the assembling surface F—F (state shown in FIG. 9). According to this assembling operation, the tooth 102*a* of the crank gear 102 is exactly engaged with the intermediate portion of the two teeth 103*a* and 103*b* of the cam gear 103, thus being firmly engaged.

As described above, if the gearing engagement between the crank gear 102 and the cam gear 103 cannot be visually identified at their assembling time, the precise gearing assembling between these two gears will be easily performed by visually observing the identification mark Z—Z.

In a modification, supposing that the crank shaft 101 is positioned at the upper dead point and the top portion of the crank gear 102 is constituted by two teeth adjacent to each other, a tooth portion positioned at a portion opposing to the top portion 120*b* of the cam 120 may be composed of one tooth of the cam gear 103 to engage the two teeth adjacent to each other of the crank gear 102 with the one tooth of the cam gear 103.

A second embodiment of this invention will be described hereunder with reference to FIG. 12, in which like reference numerals are added to members and elements corresponding to those of the first embodiment shown in FIGS. 1 to 11.

Figure 12:
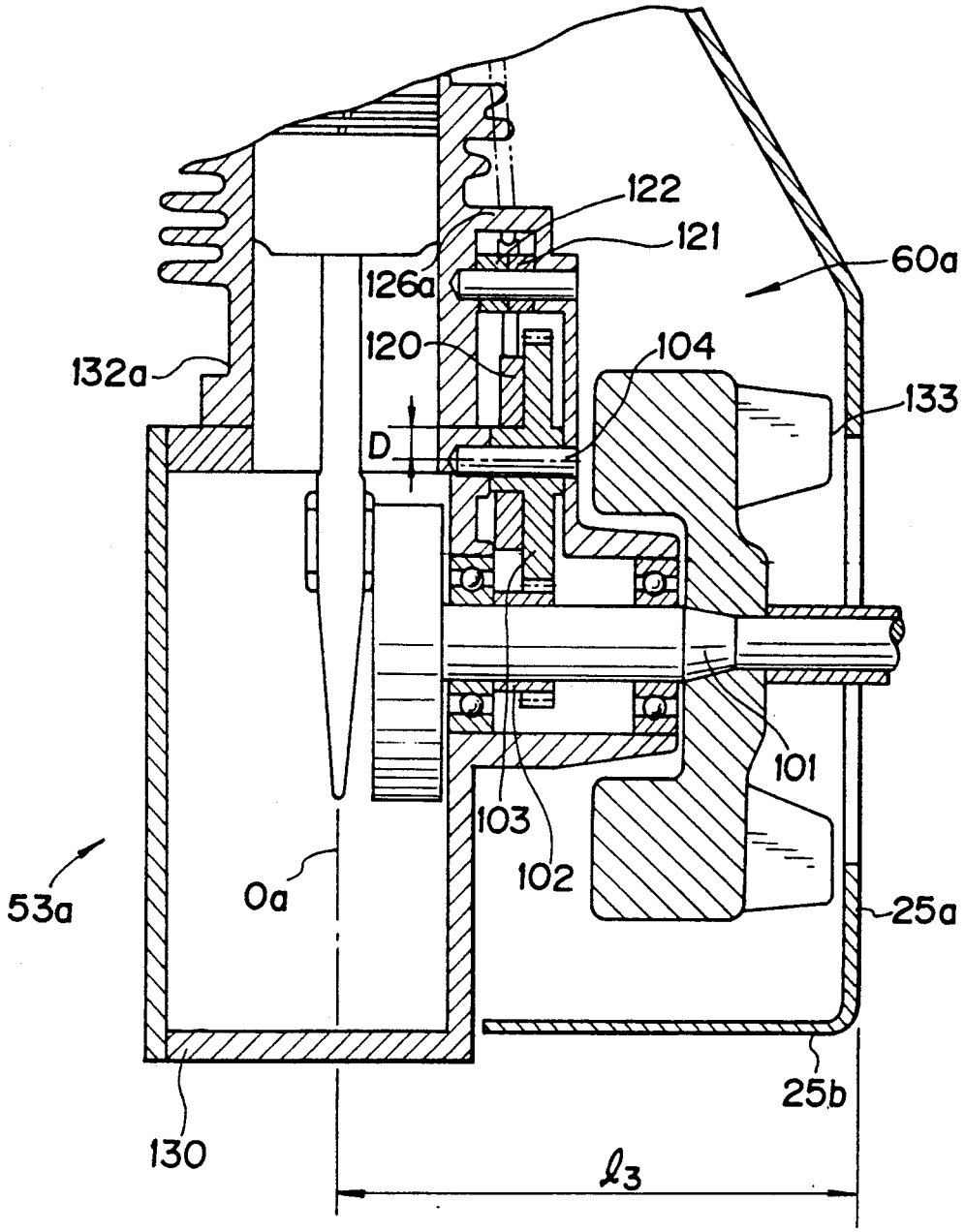
FIG. 12 is an elevational section, partially cut away, of a second embodiment of an engine unit of this invention.

Referring to FIG. 12, the valve mechanism accommodation chamber 126*a*, in which the cam 120, the cam gear 103 and the lifters 121 and 122 are accommodated, is formed integrally with the cylinder 132*a*. According to this structure, a distance between the valve mechanism accommodation chamber 126*a* and the cylinder 132*a* is minimumly reduced. In other words, the valve drive mechanism 60 and the fly wheel 133 can be located in the close vicinity of the crank case 130, and hence, the distance $l_3$ between the outer surface 25*a* of the casing 25*b* and the central portion of the piston is made small, thus making compact the engine unit 53*a* itself.

Figure 13:
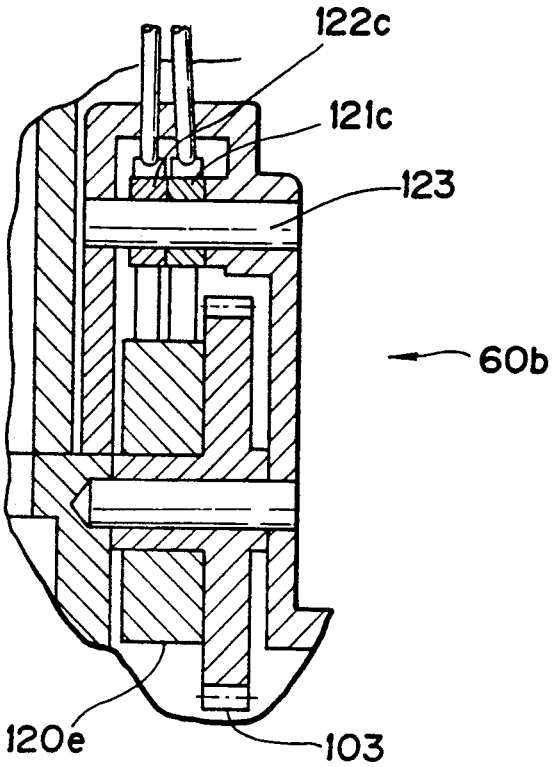

A third embodiment of this invention will be described hereunder with reference to FIGS. 13 to 15, in which like reference numerals are added to members and elements corresponding to those of the foregoing embodiments.

Figure 15A:
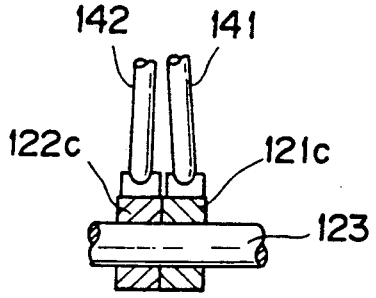
FIG. 15A is an enlarged view of a portion common to the examples shown in FIGS. 13 and 14.
Figure 15B:
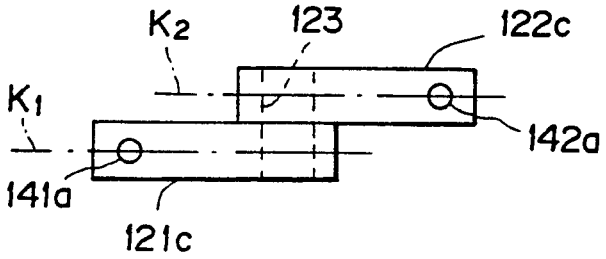
FIG. 15B is a front view of a lifter assembly shown in FIG. 13 or 14.

A valve drive mechanism 60*b* of this third embodiment includes a lifter assembly comprising a pair of lifters 121*c* and 122*c* which are not bent, in the direction of the common lifter axis 123, as made in the former embodiments and are formed substantially straightly as best shown in FIG. 15B. Namely, the contact points 141*a* and 142*a* of the lifters 121*c* and 122*d* to the push rods 141 and 142 are designed so as to position on a first plane $K_1$ and a second plane $K_2$ parallel to the plane $K_1$, respectively, which are normal to the axial direction of the lifter axis 123. Accordingly, the contacting surface of the lifters 121*c* and 122*c* to the cam 120*e* is made longer in the axial direction, whereby manufacturing cost of the lifters can be reduced.

Figure 14:
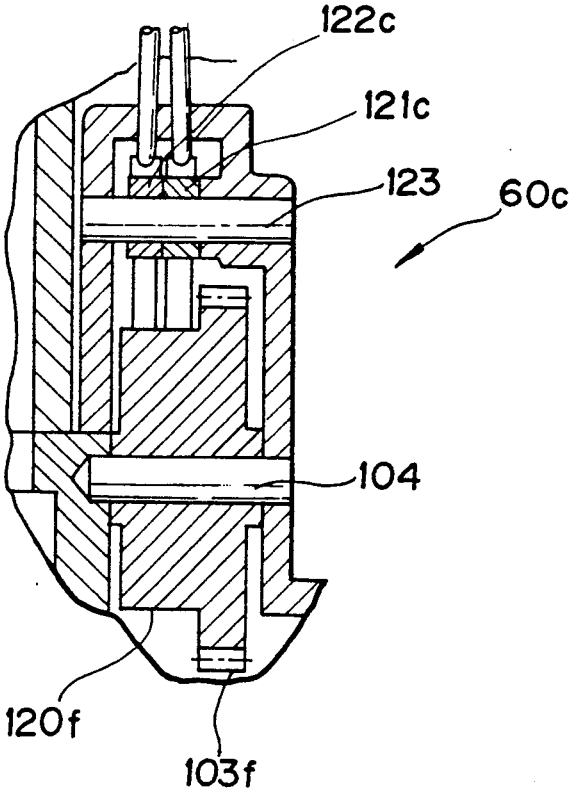

FIG. 14 shows a state in which the valve drive mechanism 60*c* includes a cam 120*f* and a cam gear 103*f* which are sintered at a high temperature by using metal powder and thus formed integrally with each other, whereby the structure of the integrated cam 120*f* and cam gear 103*f* is made strong as a whole and the manufacture thereof can be precisely and easily done. Moreover, according to the sintered connection which has porous structure, an improved lubricating property is achieved. Furthermore, the sintered connection between the cam and the cam gear will be adapted to all embodiments of this invention.

A fourth embodiment of this invention will be described hereunder with reference to FIG. 16, in which like reference numerals are added to members and elements corresponding to those described in the foregoing embodiments.

Figure 16:
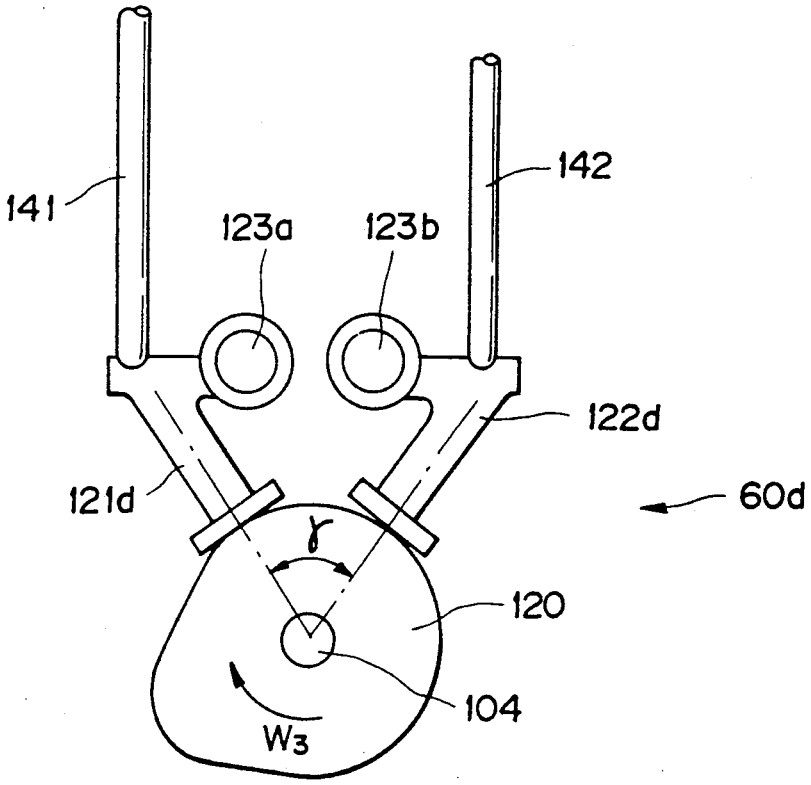
FIG. 16 shows a valve drive mechanism according to a fourth embodiment of this invention.

Referring to FIG. 16, a valve drive mechanism 60*d* of this embodiment includes a lifter assembly comprising a pair of straight lifters 121*d* and 122*d* which are rockably supported by a pair of parallel lifter axes 123*a* and 123*b* such as pins, respectively. According to this structure, the respective lifters 121*d* and 122*d* can be disposed on the same plane perpendicular to the axes 123*a* and 123*b*, and hence, the push rods 141 and 142 are both disposed on the same plane perpendicular to the cam shaft 104 without bending the lifters as shown in FIG. 4. Thus, the length of the engine unit in the axial direction of the crank shaft can be made short.

A fifth embodiment according to this invention will be described hereunder with reference to FIGS. 17 to 19, in which like reference numerals are added to members and elements corresponding to those of the former embodiments.

Usually, the crank case 130, the cylinder 132, the cylinder head 136 and etc., shown in FIG. 2, for example, constituting the engine unit of a portable working machine are formed of an aluminium alloy having a large thermal expansion coefficient for the purpose of reducing the total weight of the engine unit. In such formation, generally, the push rods 141, 142, the lifters 121, 122 and etc. constituting the valve drive mechanism 60 for driving the intake and exhaust valves are formed of an iron series material such as steel or cast iron having a small thermal expansion coefficient, so that the degree of thermal expansion of the crank case, the cylinder, the cylinder head and the like exceeds (or goes less than) that of the push rods and the lifters by the temperature increasing (or decreasing) at the time of the engine driving, which adversely results in the difference in timings of opening or closing the intake and exhaust valves at the engine cooled and heated operation times. This difference will cause the generation of large noises and it may become necessary to form valves 151 and 152 and the valve seats with a material having high heat resisting property.

In view of the above fact, according to this fifth embodiment, the push rods 141, 142 and the lifters 121, 122 of the valve drive mechanism 60 are formed of aluminium alloy of substantially the same material forming the crank case 130, the cylinder 132 and the cylinder head 136 to substantially eliminate the difference in the thermal expansion coefficients between these members. According to this structure, with reference to FIG. 2, when an oil scraping rod 138 provided for a connection rod 137 of the piston 134 scrapes highly heated lubricating oil 139 in the crank chamber, oil mist enters a cam chamber 140 through a gap of the bearing 101*b* and then is scattered into the valve chamber 146 through a cover 145 of the push rods 141 and 142. During this process, the highly heated oil 139 contacts the lifters 121, 122 and the push rods 141, 142 and thermally expands these members. However, in the case where these members are formed of the aluminium alloy, the thermal expansion degree is made large in comparison with a case that the iron series material is utilized, and accordingly, a gap (corresponding to a gap S in FIG. 20A) between the rocker arms 143, 144 and the valves 151, 152 does not vary in its size by heat.

Figure 17A:
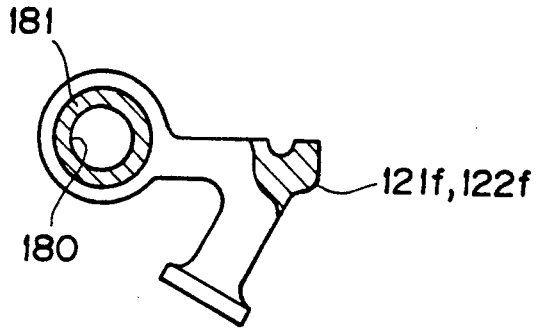
FIG. 17A, 17B and 17C show modified examples of the lifters, partially broken away.
Figure 17B:
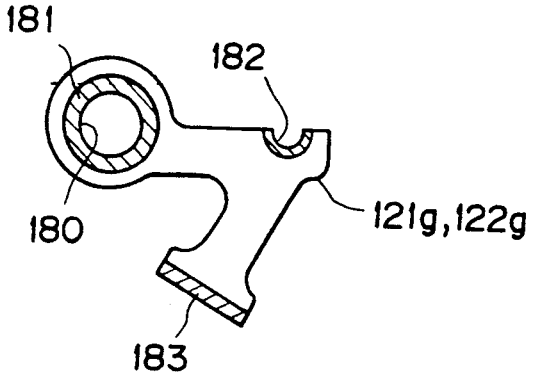
Figure 17C:
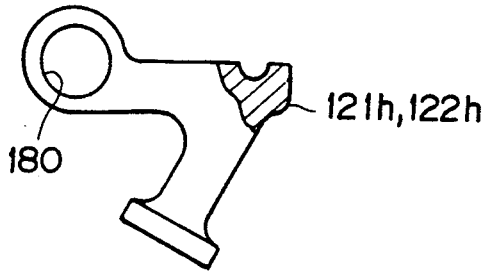

The lifters 121 and 122 of this embodiment are formed of the aluminium alloy. Lifters 121*f* and 122*f* shown in FIG. 17A are secured to a bush 181 having a thin thickness and good wear-proof property fitted in a rocking shaft hole 180 so as to abut against the inner surface of the hole 180. In addition to the structure of FIG. 17A, iron series chips 182 and 183 are cast secured to contacting surface of lifters 121*g* and 122*g* shown in FIG. 17B contacting the push rods 141 and 142 and the cam 120. Lifters 121*h* and 122*h* shown in FIG. 17C are substantially entirely formed of aluminium alloy.

Figure 18:
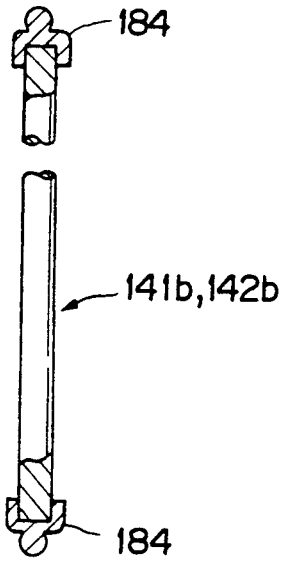
Figure 19:
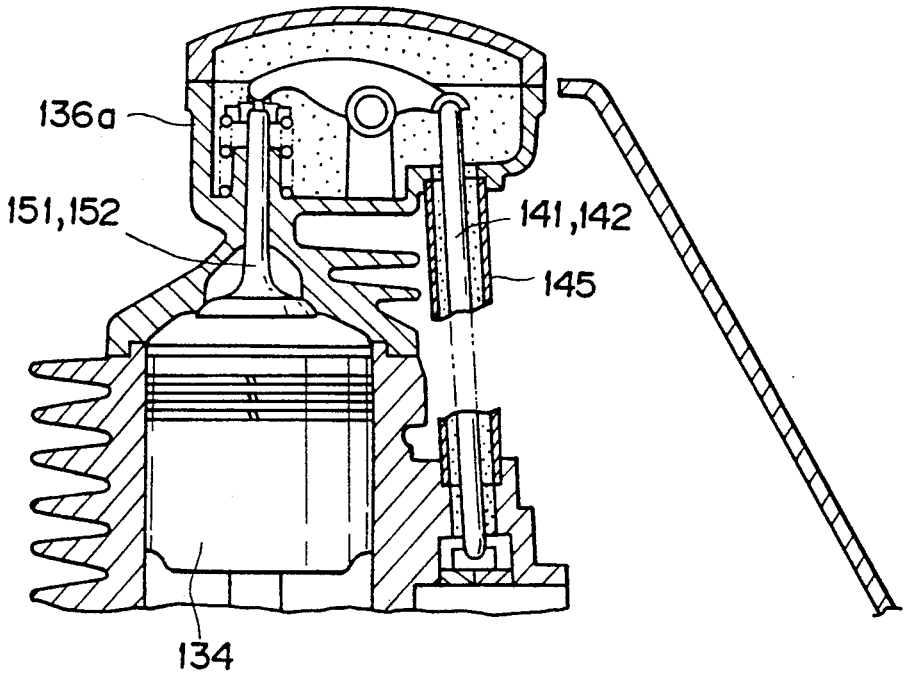

The push rods 141*b* and 142*b* are substantially formed of aluminium alloy, but as shown in FIG. 18, an iron series contacting material 184 may be secured to portions contacting the lifters 121, 122 and the rocker arms 143, 144 by press fitting means.

The formation of the lifters 121, 122 and the push rods 141, 142 with the aluminium alloys makes it possible to significantly reduce the innertia weight of the valve drive mechanism, and hence, load applied to constructional members is reduced. Accordingly, it is made possible to use the aluminium alloy for the material of the rocker arms 143 and 144, thus being effective and advantageous.

In the first embodiment of FIG. 2, when the cylinder head 136 and the valves 151, 152 are elevatably supported, a valve guide 190 for guiding the valves 151 and 152 and a valve seat 191 which is secured to the cylinder head 136 and to which the valves 151 and 152 contact, are formed of independent separate members. However, according to this fifth embodiment, as shown in FIG. 19, the cylinder head 136*a* may be composed of an integrated cast product of the valve guide and the valve seat, wherein the cylinder head 136*a* is formed of an aluminium alloy including silicon of 13.5 to 16 weight %. According to this embodiment, the difference in the thermal expansion degrees between the cylinder head and other members made of the aluminium alloy can be substantially eliminated and good wear-proof property can be also achieved. Furthermore, the number of the members or elements to be assembled can be reduced as well as machine wording processes. Moreover, in a case where the cylinder head 136*a* is formed of a particle diffusion type light alloy, high strength and high wear-proof properties will be achieved.

A sixth embodiment of this invention will be described hereunder with reference to FIGS. 20 to 23, in which like reference numerals are added to members and elements corresponding to those shown in the former embodiments.

Referring to FIGS. 20A and 20B, in this embodiment, a pair of rocker arms 243 and 244 for actuating the exhaust and intake valves 151 and 152 have a shape suitable for supporting spherical surface. The rocker arms 243 and 244 are formed on a sheet metal, for example, and swingably of rockably attached to the cylinder head 236. Namely, a stud bolt 260 is screwed in and fastened to the cylinder head 236 and the stud bolt 260 is screw engaged with a spherical socket 261. That is, the spherical socket 261 is provided with a spherical outer peripheral portion 262 at its lower end as viewed in FIG. 20A, and the rocker arms 243 and 244 have inner spherical surfaces suitable for slidably contacting the spherical outer peripheral portion 262 of the socket 261. The stud bolt 260 is provided at its one end with threads 264 which are engaged with screws formed to the spherical socket 261. Reference numerals 265 and 266 denote a valve spring and a push rod guide, respectively.

These members and elements are assembled in the following manner.

Under the valve closed state, a predetermined gap S is formed between the rocker arms 243 and 244 and the head portions of the exhaust and intake valves 151 and 152 for preventing the valves from not being closed due to the thermal expansion during the operation of the engine unit. The adjustment of the gap S is performed in a manner such that the spherical socket 261 is rotated along the threads 264 of the stud bolt 260 so as to vertically move the socket 260, which is then locked at a portion at which a desired gap S is obtained by fastening a lock nut 267. The lifters are then swung in accordance with the rotation of the cam 120 and, hence, the push rods 141 and 142 abutting against the lifters 141 and 142 carry out the vertical motions. According to these vertical motions, the rocker arms 243 and 244 are rocked along the spherical outer surface 262 of the spherical socket 261 and the valves 151 and 152 are then actuated against the spring force of the valve spring 265. Since the rocker arms 243 and 244 are held by the spherical outer peripheral surface 262 of the socket 260 and the inner spherical surfaces of the rocker arms 243 and 244, there is no means for limiting the motion in a direction normal to the drawing sheet surface of FIG. 20A. Accordingly, it will be necessary to locate the independent push rod guide 266 for guiding the motion of the push rods 141 and 142. In such location, it will be basically necessary to arrange, in the same plane, the acting direction 268 of the valves 151, 152, the acting direction 269 (FIG. 20B) of the push rods 141, 142 and the center of the spherical surfaces of the rocker arms 243 and 244. Namely, when the rocker arms 243 and 244 are rocked in the plane of the drawing sheet surface, the positions thereof are limited by the guide 266 only by soft touch of the push rod guide 266 to the push rods 141 and 142, and accordingly, the actuation of the exhaust and intake valves 151 and 152 can be stably maintained. However, in a case where an inclination as shown in FIG. 20C exists between the acting direction 268 of the valves 151, 152 and the acting direction 269 of the push rods 141, 142, a friction force is always applied to the push rods 141, 142 and the push rod guide 266 to disturb the motions of the exhaust and intake valves 151, 152.

Figure 21:
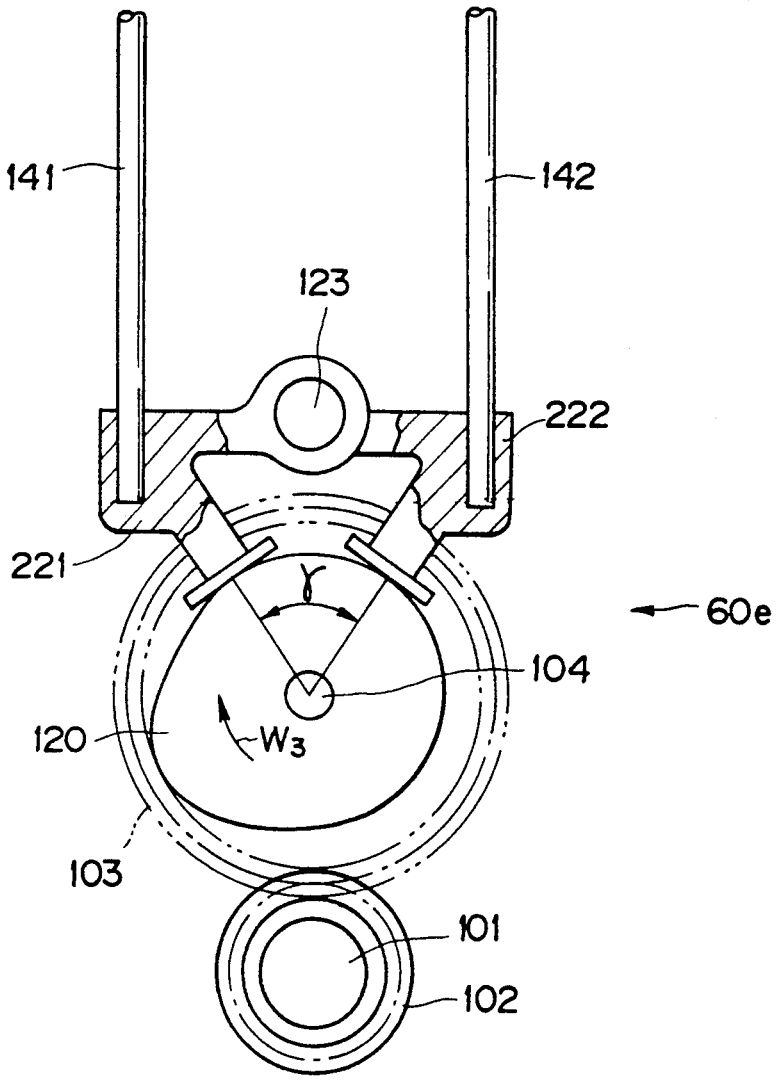
Figure 22:
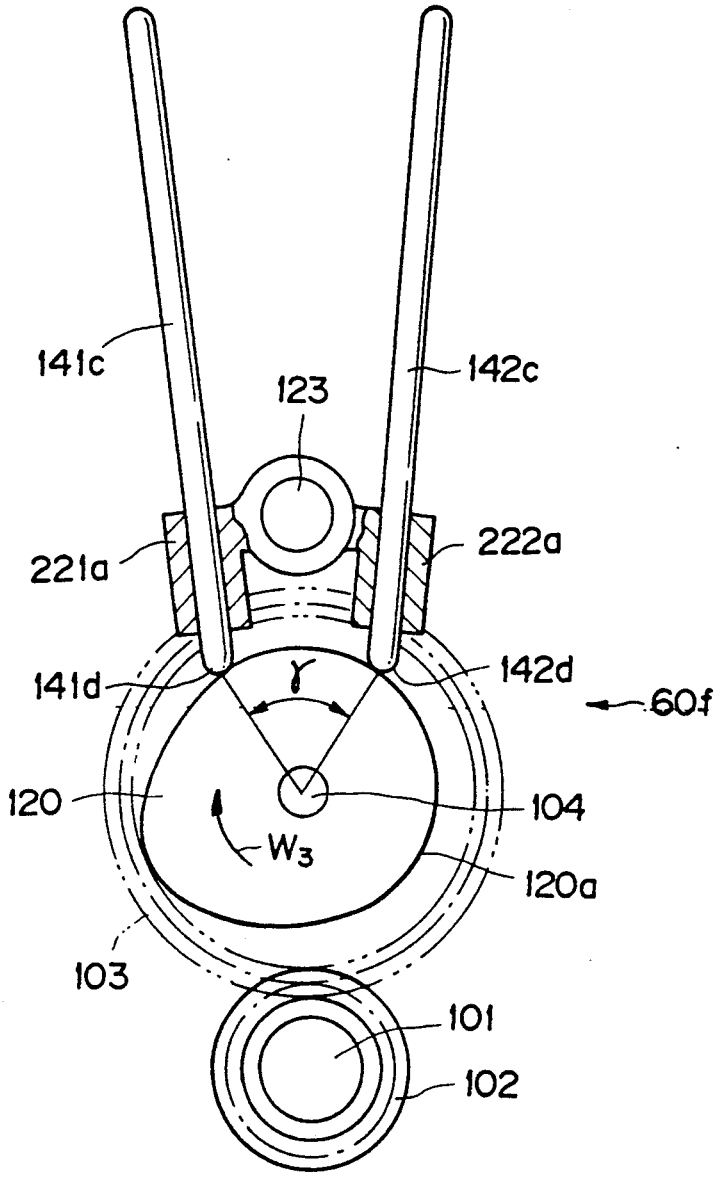
Figure 23:
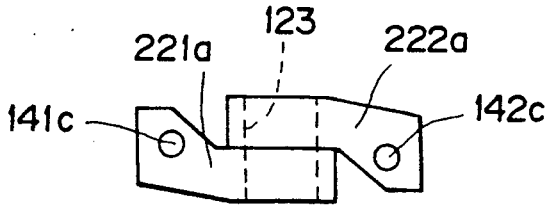

In view of this matter, according to this embodiment, the valve drive mechanism is constructed as shown in FIGS. 21 to 23, in which FIG. 21 shows the valve drive mechanism **60*e* provided with lifters 221 and 222 formed by improving the lifters 121 and 122 shown in FIG. 3**.

Referring to FIG. 21, the lower ends of the push rods 141 and 142 for the exhaust and intake valves 151 and 152 are secured to the swing type lifters 221 and 222, respectively, by press fitting means or casting means.

The lifters 221 and 222 have substantially identical structures as those shown in FIG. 4 when they are visually viewed from the upper side thereof. That is, the respective lifters 221 and 222 are formed in bent manner from the lifter axis 123 side to the central side so that the push rod 141 for the exhaust valve 151 and the push rod 142 for the intake valve 152 are arranged in the same plane.

Furthermore, the upper ends of the push rods 141 and 142 abut against the rocker arms 243 and 244 (FIG. 20A), which are guided by the spherical socket 261, and the exhaust valve 151 and the intake valve 152 are opened or closed in accordance with the reciprocal motions of the push rods 141 and 142.

According to these structures, the moving positions of the push rods 141 and 142 are limited three dimensionally, and therefore, the upper ends of these push rods, i.e. positions T abutting against the rocker arms 243 and 244, are secured three dimensionally, whereby it is not necessary to incorporate the push rod guide 266 as shown in FIG. 20A or 20B and it is also possible to be commonly assembled with the spherical rocker arms 243 and 244.

FIGS. 22 and 23 represent a modification of the sixth embodiment.

In a modified valve drive mechanism **60*f*, one ends 141*d* and 142*d* of the push rods 141*c* and 142*c* for the exhaust valve 151 and the intake valve 152 penetrate a pair of rockable lifters 221*a* and 222*a* and secured thereto by press fit means or casting means. The ends 141*d* and 142*d* directly abut against one cam 120 and elevated in accordance with the rotation of the cam 120. When the ends 141*d* and 142*d* contact the circular circumferencial portion 120*a* of the cam 120, the angle $\gamma$ is constituted by two lines connecting the contacting points of the ends 141*d* and 142*d* on the circular cam surfaces with the center point of the cam shaft 104. Accordingly, since the moving positions of the respective push rods 141*c* and 142*c* are limited three-dimensionally, the positions of the upper ends of the push rods 141*c* and 142*c*** can be secured three-dimensionally.

Accordingly, likewise the case of FIG. 21, the push rod guide 266 can be eliminated and the spherical rocker arms 243 and 244 can be used in combination. Furthermore, in this modified embodiment of FIGS. 22 and 23, the lifters **221*a* and 222*a* do not contact with the cam 120**, it is not necessary to form the lifters with expensive material having high wear-proof property and the lifters may be formed of a light metal alloy, thus reducing the weight of the lifters.

Figure 24:
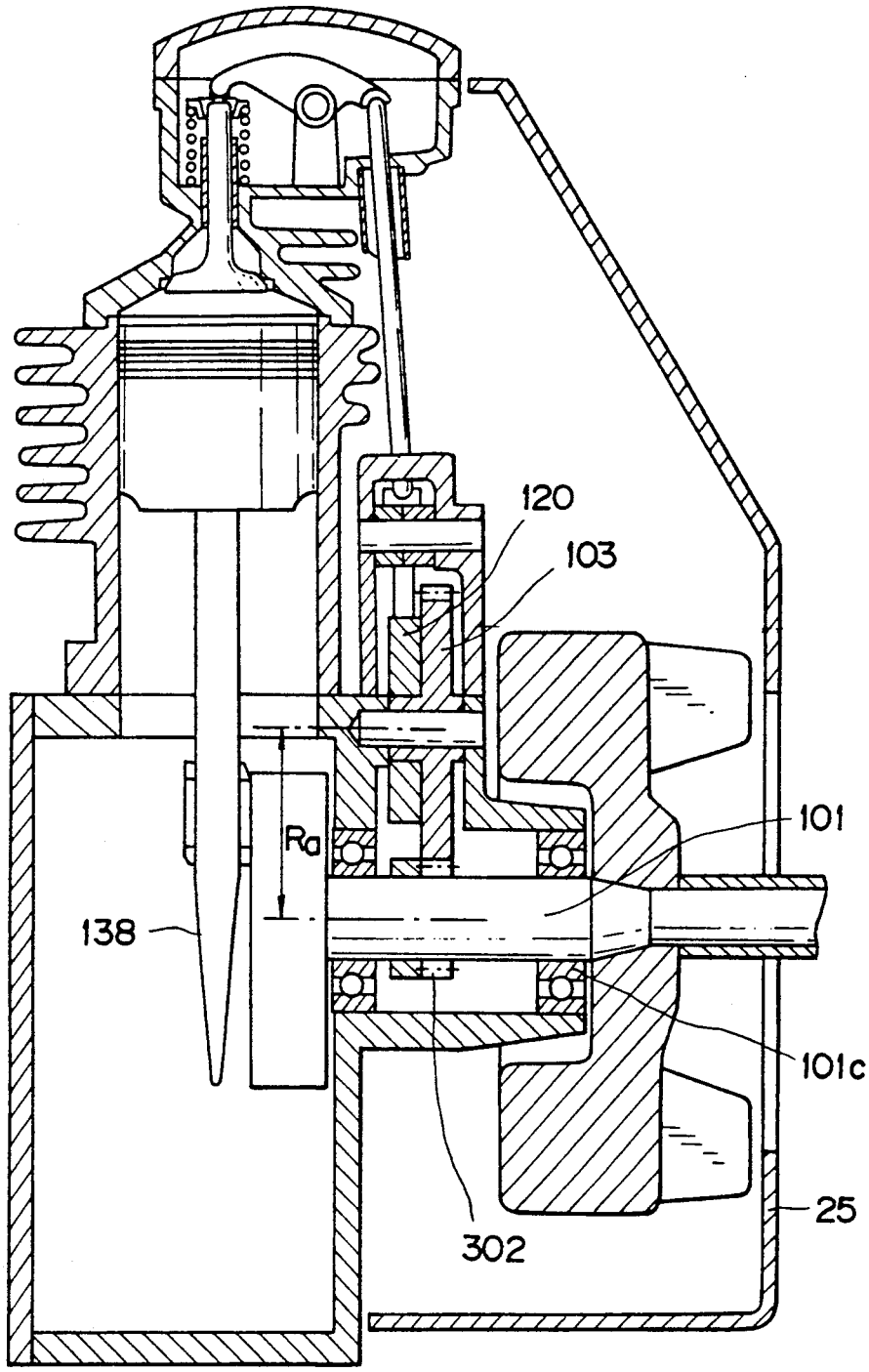

A seventh embodiment of this invention will be described hereunder with reference to FIGS. 24, to 27, in which like reference numerals are added to members or elements corresponding to those shown in the former embodiments.

Figure 27A:
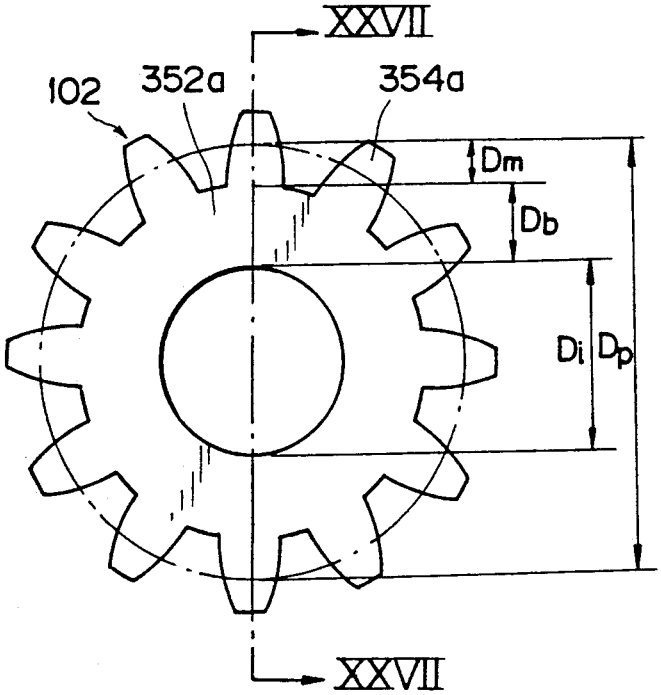
FIG. 27A is a front view of a general spur gear.
Figure 27B:
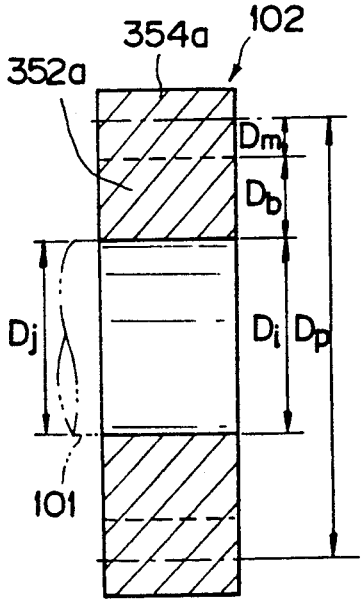
FIG. 27B is a sectional view taken along the line XXVII—XXVII of FIG. 27A.

In this embodiment, the structure of the crank gear 102 (FIG. 2) is improved. The crank gear shown in FIG. 2. FIG. 27A and 27B is a spur gear of general structure having a central circular portion **352*a* and a tooth portion 354*a* formed at the outer periphery of the central portion, and it is necessary for the spur gear of such structure to have a predetermined thickness in the radial direction of the central portion 352*a* for preventing the cracking of the gear itself. Accordingly, the use of such spur gear as the crank gear had a limit in the prior art for reducing the diameter of a pitch circle of the crank gear 102 with respect to the diameter of the crank shaft 101**.

Figure 25:
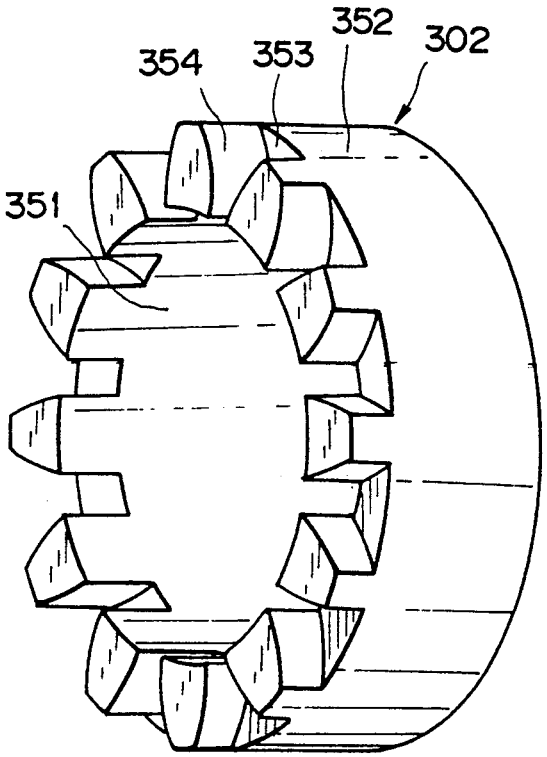
Figure 26A:
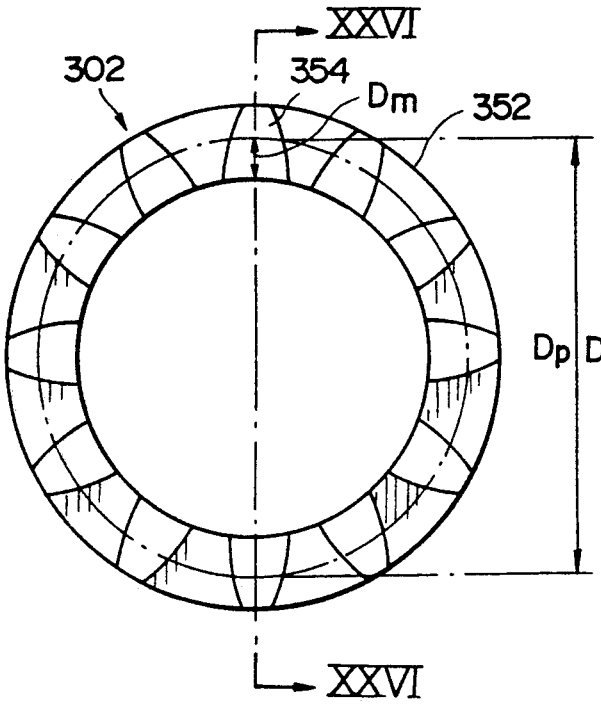
FIG. 26A is a front view of the gear member of FIG. 25.
Figure 26B:
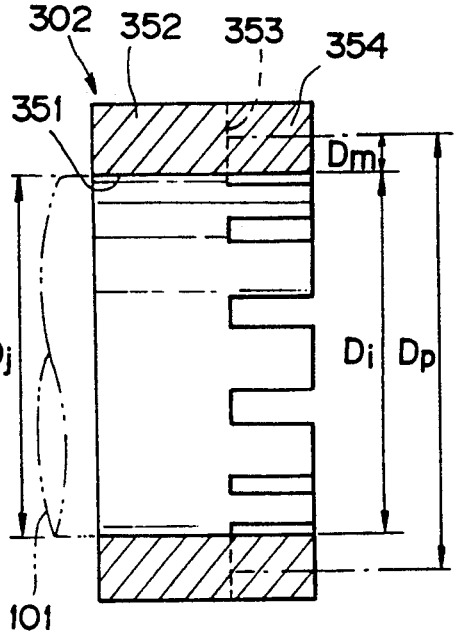
FIG. 26B is a sectional view taken along the line XXVI—XXVI of FIG. 26A.

In order to solve this defect, the crank gear is improved in its structure in this embodiment such as shown in FIGS. 25 and 26. Namely, referring to FIGS. 25 and 26, a crank gear 302 is formed as a ring shape gear having an inner columnar hollow space and the outer periphery and inner periphery of this ring-shaped crank gear 302 are formed concentrically. The crank gear 302 thus has a hollow support portion 352 having an inner hollow portion as a fitting hole 351, and a tooth portion 354 having a plurality of teeth formed in gear shape is formed projectingly on one side surface of the support portion 352 of the crank gear 302 as best shown in FIG. 25. The tooth portion of the cam gear 103 is engaged with the tooth portion 354 of the crank gear 302 to thereby rotate the cam gear 103 in accordance with the rotation of the crank shaft 101 through this gearing engagement.

The diameter of the pitch circle of the crank gear 302 is shown as Dp in FIG. 26, and the diameter of the fitting hole 351 is referred to as Di. The diameter Dp of the pitch circle with respect to the axis diameter Dj of the crank shaft 101 to be fitted to the fitting hole 351 is expressed as $Dp=Dj+\alpha_1$, that is, $\alpha_1=Dp-Dj$. Further, since the diameter Dj is nearly the inner diameter Di, $Dj\approx Di$, the expression of $\alpha_1=Dp-Di$ will be established. Now, when a height of a tooth base of each tooth of the tooth portion 354 is referred to as Dm as shown in FIG. 26A, the diameter Dp is expressed as $Dp=Di+2\times Dm$, and accordingly, $\alpha_1=Di+2\times Dm$-

$-Di=2\times Dm$. Consequently, the diameter Dp is expressed as $Dp=Dj+2\times Dm$.

On the other hand, in the conventional spur gear, as shown in FIGS. 27A and 27B, the diameter Dp is expressed as $Dp=Dj+\beta_1$, wherein since $\beta_1=Dp-Dj$ and $Dj\approx Di$, $\beta_1=Dp-Dj$, and accordingly, $Dp=Di+2\times Db+2\times Dm$, that is, $\beta_1=Di+2\times Db+2\times Dm-Di=2\times Db+2\times Dm$ (Dm: height of a tooth base of each tooth of the tooth portion 354*a*; Db: thickness of the support portion 352*a*). Consequently, the equation of $Dp=Dj+2\times Db+2\times Dm$ is obtained.

As can be understood from the above comparison, according to the present embodiment, the diameter Dp of the pitch circle of the crank gear 302 can be reduced with respect to the crank shaft 101 by the length of two times the thickness Db of the support portion 352*a* (FIG. 27B) of the conventional spur gear.

Particularly, according to a conventional general gear, when it is required to reduce the diameter of the pitch circle, it is necessary to make slender a shaft to be fitted or make thin the thickness of the support portion of the gear, which, however, results in the reduction of the strength of the shaft and the gear. On the contrary, according to this embodiment, the diameter of the pitch circle can be made small without changing the diameter of the shaft to be fitted and the thickness of the support portion of the gear. That is, in the case of the same diameter of the pitch circle, the diameter of the shaft can be made large according to this embodiment, thus forming the crank gear with sufficient strength. Furthermore, for a portable working machine, it is a matter of desire to make compact and light an engine unit, so that, according to the embodiment of this invention, the engine unit can be made compact by reducing the size or weight of the crank gear 302 of the structure described above.

Furthermore, the seventh embodiment is not limited to the improvement of the crank gear and the described structure of the gear may be applied to other gear such as a cam gear. The number and the shape of the gear tooth is a matter of option as well as the teeth of the tooth portion of the support portion.

Furthermore, it may be possible to provide a connection flange of thin disk-like structure at a bottom portion of the tooth portion end side to thereby integrally form the respective teeth. Sintering technology and cutting work may be also applied for the formation of such gears, and the thus manufactured gear may be utilized for not only various kinds of engine units but also other equipments in various art fields.

An eighth embodiment of this invention will be described hereunder with reference to FIGS. 28 to 37, in which like reference numerals are added to members and elements corresponding to those of the former embodiments.

Figure 28:
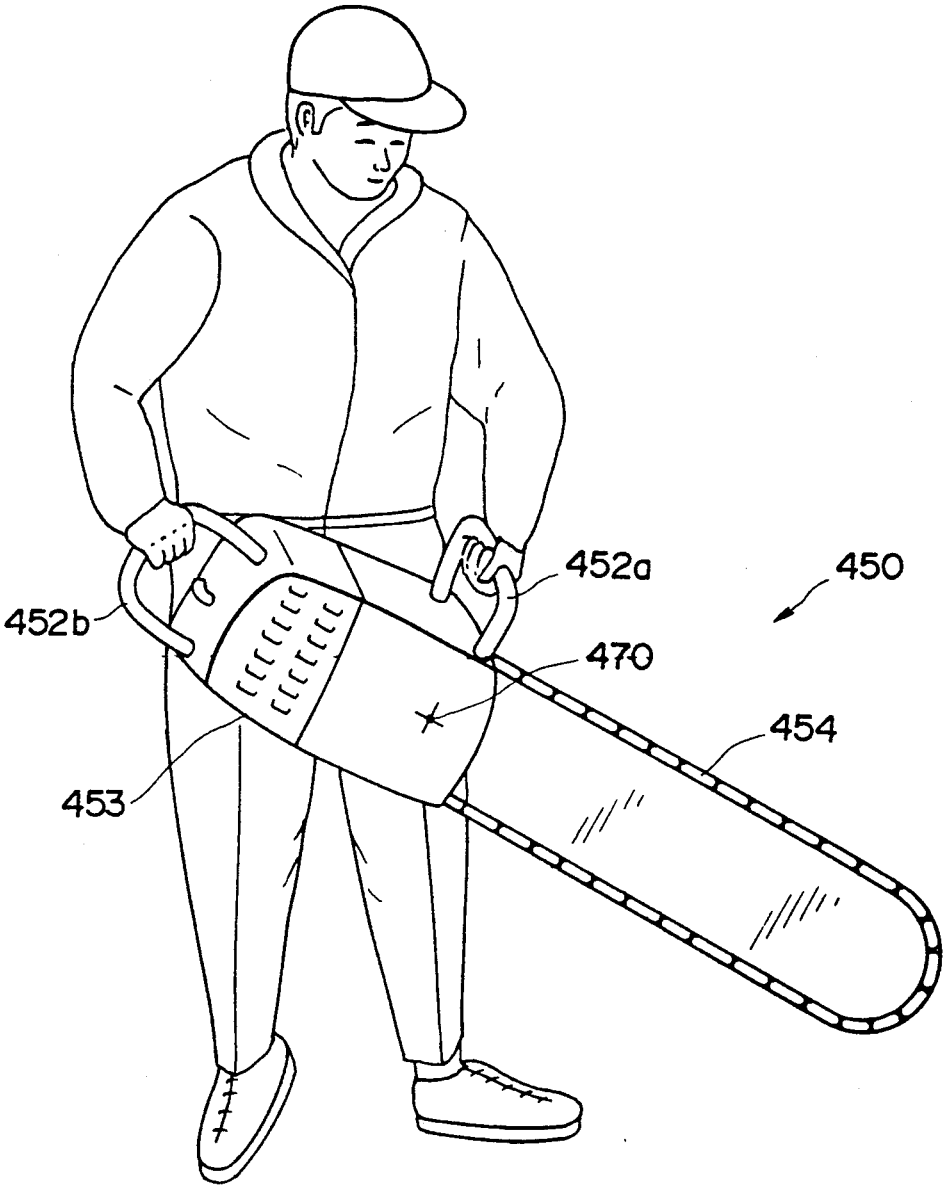

FIG. 28 is a view similar to that of FIG. 1, in which is shown a chain saw provided with an engine unit according to this invention in place of a lawn mower.

The chain saw 450 is equipped with an engine unit 453 and, in the illustration of FIG. 1, the rotating direction of the output shaft of the chain saw 450 reverses to that of the output shaft of the lawn mower of FIG. 1.

Figure 29:
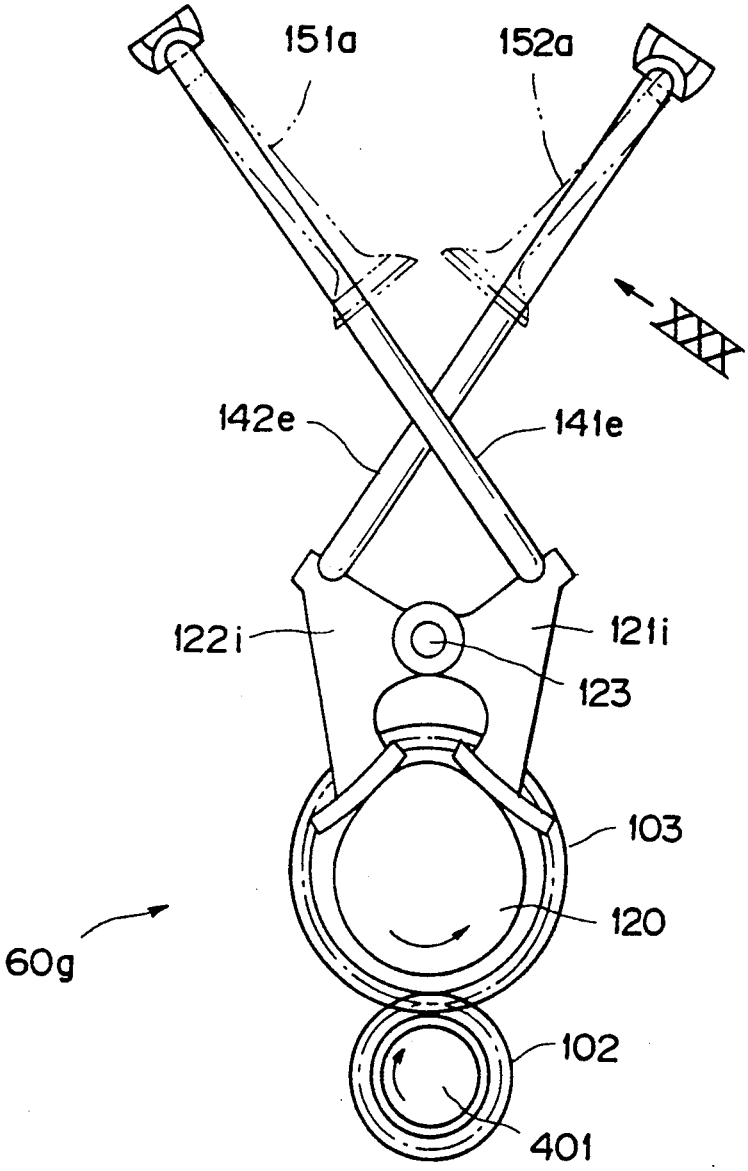

In FIG. 29, the front side of the drawing sheet surface is a power take-out side of a crank shaft 401.

Figure 32:
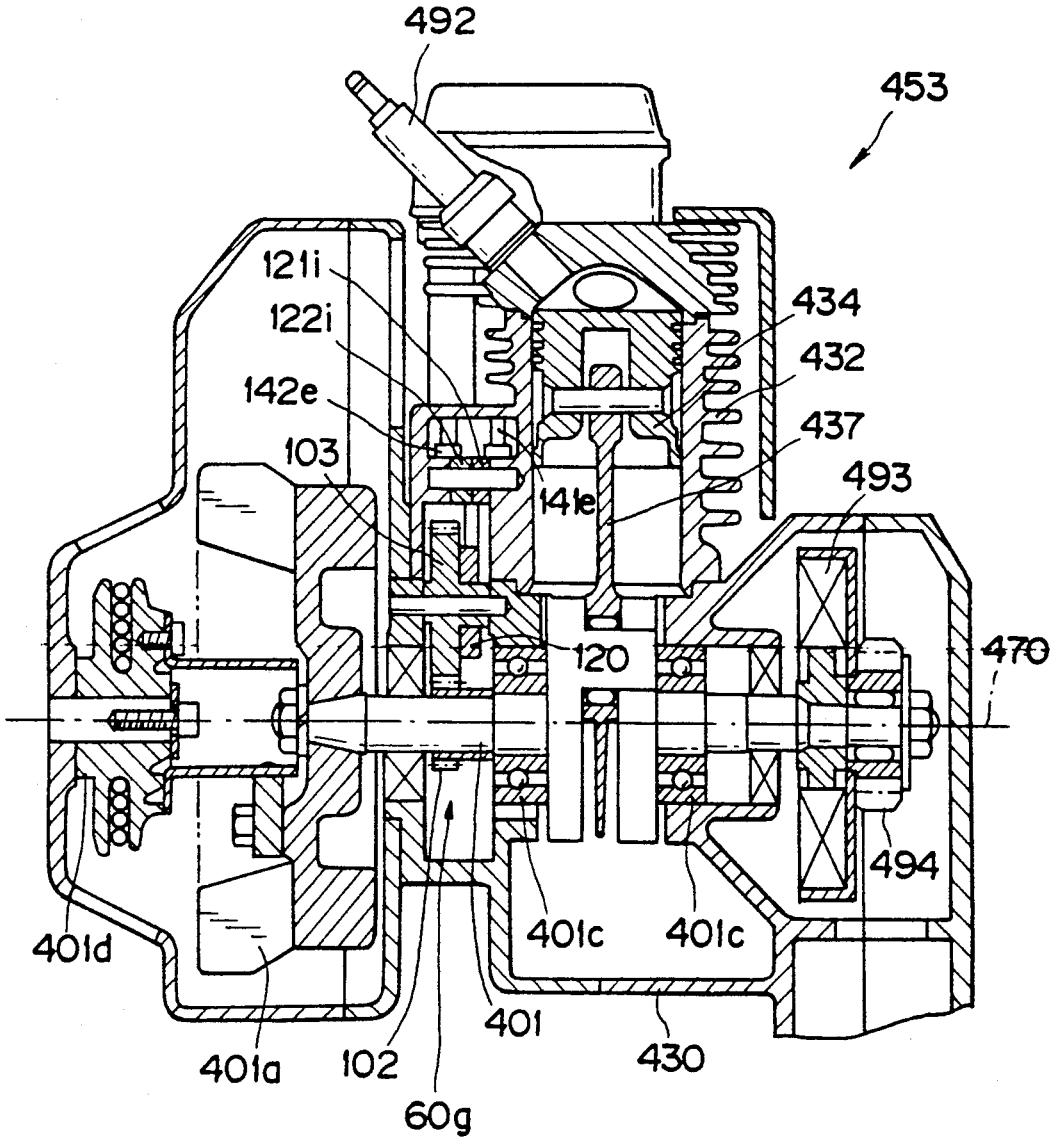

FIG. 32 is a sectional view as viewed from the lower side of the engine unit 453 of FIG. 28, and an operator is positioned on the lefthand side in FIG. 32. The exhaust valve is positioned on the front side of the drawing sheet and the intake valve is hence positioned on the rear side thereof.

Referring to FIG. 28, a power is taken out through a power transmission unit including a sprocket, a gear, a belt and the like in a direction normal to the center line 470 of the crank shaft. To the engine unit 453 are attached an upper handle 452*a* on the side of a working device 454, a chain in this embodiment, and a rear handle 452*b*, these handles being gripped by hands of the operator when used. The intake port is disposed on the upper side of the engine unit 453 and the exhaust port is disposed on the lower side thereof for avoiding the spitting of the heated exhaust gas towards the operator. In this meaning, a muffler member is disposed on the power take-out side or lower portion of the engine unit, and the exhaust port of the exhaust gas is disposed on the power take-out side apart from the operator. The rotating direction of the working device 454 is selected to a direction in which cut chips are not directed towards the operator.

Figure 30:
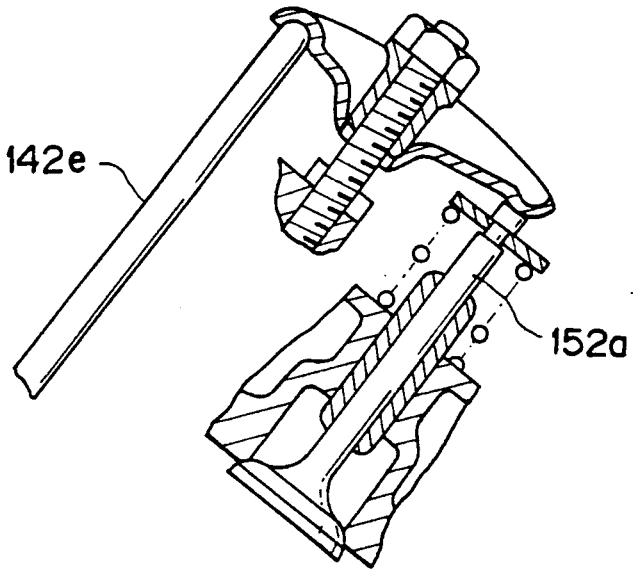

A valve drive mechanism 60*g* of this eighth embodiment will be represented in FIGS. 29 and 30, in which the valve drive mechanism 60*g* includes one cam 120 and a lifter assembly comprising a pair of rockable lifters 121*i* and 122*i* abutting at their one ends against the cam 120, and these lifters 121*i* and 122*i* have a common lifter axis 123 such as a pin about which the lifters are rockable.

In this eighth embodiment, the gear 103 of the cam 120 is also arranged to be meshed with the gear 102 of the crank shaft 401, and one lifter 121*i* is coupled with a push rod 141*e* for the exhaust valve and the other lifter 122*i* is coupled with a push rod 142*e* for the intake valve, these lifters in this embodiment being in cross arrangement, and both the valves are arranged with an angle difference therebetween.

Figure 31:
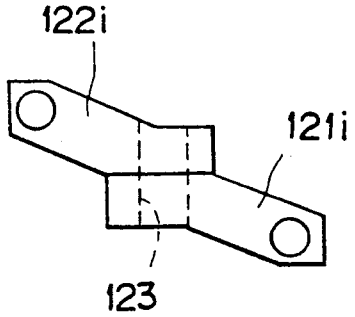

As shown in FIG. 31, as an upper side view, the lifters 121*i* and 122*i* are formed symmetrically with the same material and shape.

The valve drive mechanism 60*g* of the structure described above will be operated in the following manner.

When the crank shaft 401 is driven and rotated in the clockwise direction, as viewed from the power take-out side in the drawings, the cam gear 103 of the cam 120 meshed with the crank gear 102 mounted onto the crank shaft 101 is hence rotated in the counterclockwise direction (FIG. 29). Then, the cam 120 is also rotated in the counterclockwise direction to thereby rock the lifter 121*i* and the exhaust valve 151*a* is opened through the motion of the push rod 141*e* abutting against the lifter 121*i*. When the cam 120 is further rotated in the same direction, the other lifter 122*i* is rocked and the intake valve 152*a* is opened through the motion of the push rod 142*e*. After the predetermined time, the exhaust and intake valves 151*a* and 152*a* are closed with the predetermined timings, respectively. The valve operation cycle has thus been completed. As described above, two lifters are rocked by the rotation of one cam 120, so that the axial length of the cam can be reduced and the weight of the cam can be also made light.

The incorporation or assembling of the valve drive mechanism 60*g* to the four-stroke cycle engine unit 453 of the portable working machine is shown in FIG. 32. Referring to the state of FIG. 32, the valve drive mechanism 60*g* is positioned on a side opposite to the working machine drive side (right side in FIG. 32), and as visually viewing the engine unit from the working machine driving side, the exhaust valve 151*a* is positioned on the left side of the center line of the cylinder and the intake valve 152*a* is positioned on the right side thereof. As shown in FIG. 29, the crank shaft 101 is rotated clockwisely, the cam 120 is rotated counter-clockwisely, and the push rods 141*e* and 142*e* are cross arranged to operate the exhaust and intake valves 151*a* and 152*a*, so that the operator who stands on the intake side never be suffered from the spitting of the heated exhaust gas. A piston 434 is coupled, through a connection rod 437, with the crank shaft 401 rotatably supported by a pair of bearings 401*c* in a crank case 430 so as to reciprocate in a cylinder 432. A cooling fan 401*a* is provided for one end of the crank shaft 401 and a starter pulley 401*d* is disposed outside the cooling fan 401*a*. An ignition plug 492 is provided for the cylinder head of the cylinder, and a centrifugal clutch 493 and a power take-out sprocket 494 are disposed on a side opposite to the location of the cooling fan 401*a*.

Furthermore, according to this embodiment, the lift curves of the exhaust valve 151*a* and the intake valve 152*a* can be made different as shown in FIG. 7B by utilizing a pair of lifters 121*i* and 122*i* and the cam having a configuration symmetric in shapes on the push rod lift-up side and lowering side.

Figure 33:
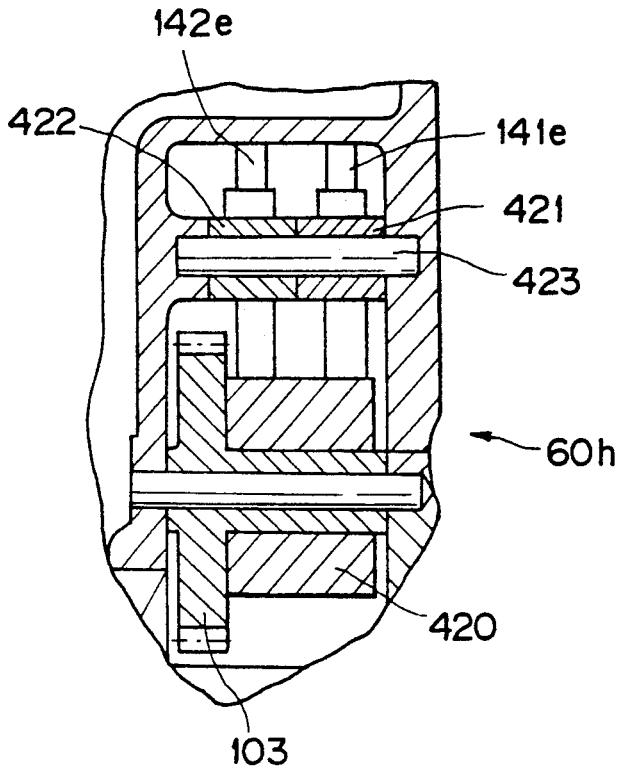
Figure 34:
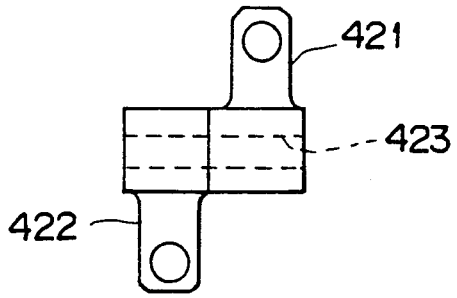

FIGS. 33 and 34 represent a modification of the eighth embodiment and show a valve drive mechanism 60*h*. In this modified embodiment, a pair of lifters 421 and 422 rockably mounted onto a common lifter axis 423 have structures more simple in comparison with the structure shown in FIG. 31, and the axial width of the cam 420 is made wide to reduce the manufacturing cost of the lifters 421 and 422.

Figure 35:
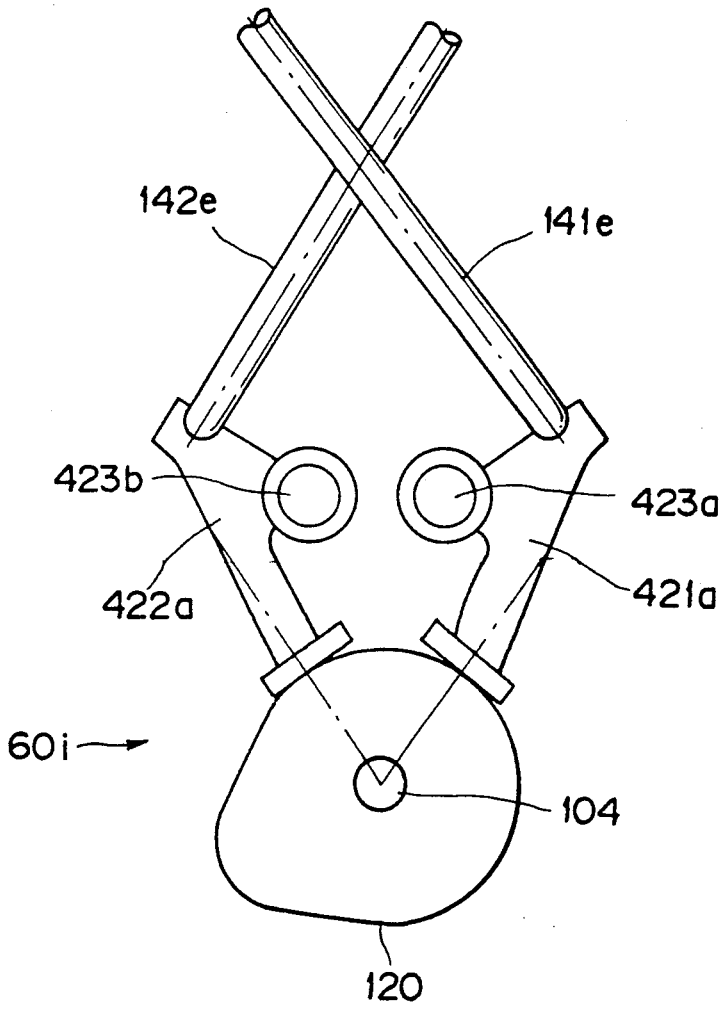

FIG. 35 shows another modification of the eighth embodiment, in which a valve drive mechanism 60*i* including a pair of lifters 421*a* and 422*a* which are mounted onto the independent two axes. However, in this modified embodiment, the lifters may be bent as shown in FIG. 31 and both push rods 141*e* and 142*e* can be disposed on substantially the same plane normal to the cam shaft 104, whereby the axial length of the crank shaft can be made short, thus also making the engine unit itself compact and light.

Figure 36:
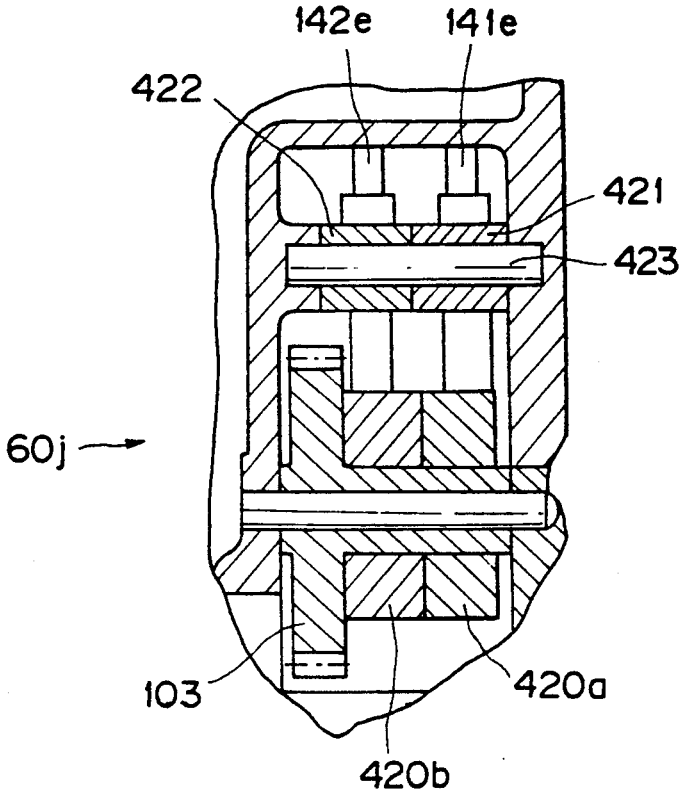
Figure 37:
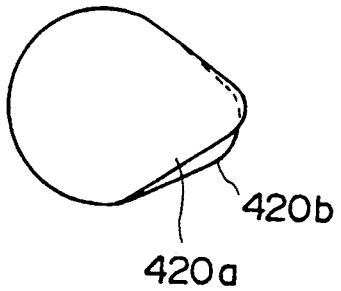

FIGS. 36 and 37 show a further modification of the eighth embodiment, in which a valve drive mechanism 60*j* includes two independent cams 420*a* and 420*b* for the exhaust valve and the intake valve, though, in the embodiment of FIG. 33, one cam 420 is utilized. The lifters 421 and 422 are rocked by these cams 420*a* and 420*b*, respectively, to thereby elevate the push rods 141*e* and 142*e*. According to this structure, the valve lift curves and the valve opening-closing timings of the exhaust valve 151*a* and the intake valve 152*a* can be optimumly set.

It is to be understood that this invention is not limited to the described embodiments and many other changes and modifications may be made without departing from the scopes of the appended claims.

What is claimed is:

1. A lightweight four-stroke cycle engine unit able to be carried by a user, the engine unit comprising:

an aluminum alloy outer casing having a single cylinder bore formed therein aligned along a generally vertical cylinder axis;

an aluminum alloy piston reciprocally cooperating within said cylinder bore defining a variable displacement chamber;

a crankshaft rotatably mounted relative to the outer casing and operably connected to the piston by a connecting rod;

an intake and exhaust valve cooperating with the variable displacement chamber and a valve drive mechanism for opening and closing the intake and exhaust valves in timed sequence, said valve drive mechanism including:

a crank gear mounted on the crankshaft for rotation therewith wherein said camshaft, crankshaft and cylindrical bore axis lie in a common central plane;

a camshaft assembly having a cam gear cooperating with the crank gear and a single cam lobe;

a lifter assembly including a pair of intake and exhaust lifters each pivotably mounted relative to the cylinder bore and rotatable about an axis which is parallel to the crankshaft axis of rotation, said lifter engaging the cam lobe and being rocked in response to the rotation of the camshaft assembly;

a pair of intake and exhaust push rods cooperating with the intake and exhaust lifters which are translated in response to the rotation of the cam lobe; and a pair of intake and exhaust rocker arms pivotably cooperating with the outer casing and operably connecting the intake and exhaust push rods through the intake and exhaust valves.

2. A four-stroke cycle engine unit according to claim 1, wherein said intake and exhaust lifters are provided with end portions abutting against the cam lobe to be rockable, said cam lobe having an outer contour including a maximum lift point and bilateral outer peripheral cam surfaces, on lifting and lowering sides of the intake and exhaust push rods, which are symmetric with the maximum lift point being a center of the symmetry, and wherein said intake and exhaust lifters have contacting surfaces contacting an outer periphery of the cam lobe and contact points contacting the intake and exhaust push rods, said push rods and lifters being arranged symmetrically with respect to said central plane.

3. A four-stroke cycle engine unit according to claim 2, wherein the contacting surface of the intake and exhaust lifters contracting the cam lobe are flat.

4. A four-stroke engine unit according to claim 2, wherein said intake and lifters are bent so that the contact points of the lifters contacting the first and second push rods lie on the same plane normal to an axial direction of the lifter axis portion.

5. A four-stroke engine unit according to claim 2, wherein said intake and lifters are straight and perpendicular to the lifter axis so that the contact points of the lifters contacting the intake and exhaust push rods lie respectively on a first and a second plane being parallel to each other and normal to an axial direction of the lifter axis portion.

6. A four-stroke cycle engine unit according to claim 1, wherein said cam gear has provided on an outer surface thereon with an identification means so that, when the crank shaft is positioned at an upper dead point, a top portion of the crank gear is exactly meshed with a tooth portion of the cam gear positioned opposingly thereto.

7. A four-stroke cycle engine unit according to claim 6, wherein when the crank shaft is positioned at the upper dead point, said identification means is formed at a position corresponding to the outer casing surface as a groove extending in a direction crossing a line connecting a center of the cam gear with the cam gear top portion.

8. A four-stroke cycle engine unit according to claim 6, wherein either one of the tope portions of the crank gear and the cam gear comprises two teeth adjacent to each other and other one of the top portions is one tooth to be meshed with a portion intermediate two teeth.

9. A four-stroke cycle engine unit according to claim 1, wherein said cam means, said cam gear means and said lifter assembly are accommodated in a valve mechanism accommodation chamber, said valve mechanism accommodation chamber being formed integrally with the outer casing.

10. A four-stroke cycle engine unit according to claim 1, wherein said cam gear and said cam gear are integrally formed by means of sintered alloy.

11. A four-stroke cycle engine unit according to claim 1, wherein a pair of intake and exhaust lifters pivotably cooperate with the outer casing about intake and exhaust lifter axes, respectively, which are positioned on opposite sides of the central plane.

12. A four-stroke cycle engine unit according to claim 1, wherein said crank shaft is accommodated in a crank case to which the cylinder outer casing is secured and wherein said crank case and said cylinder outer casing are formed of aluminum alloy and said intake and exhaust push rods and lifters are formed of aluminum alloy of a composition substantially the same as that of the aluminum alloy of the crank case and the cylinder.

13. A four-stroke cycle engine unit according to claim 12, wherein said intake and exhaust lifters are provided with holes through which lifter axis portion is inserted through which lifter axis portion is inserted through a bush member having a thin thickness and a wear-proof property.

14. A four-stroke cycle engine unit according to claim 13, wherein said intake and exhaust lifters having contacting surfaces contacting the intake and exhaust push rods and wherein chips made of an iron series metal are casted and secured to the contacting surfaces of the lifters.

15. A four-stroke cycle engine unit according to claim 12, wherein said intake and exhaust lifters are formed substantially entirely of aluminum alloy.

16. A four-stroke cycle engine unit according to claim 12, wherein said intake and exhaust push rods have contacting portions contacting the intake and exhaust lifters and rocker arms and wherein iron series metal members are secured to the contacting portions of the intake and exhaust push rods.

17. A four-stroke cycle engine unit according to claim 12, wherein the outer casing is provided with a cylinder head to which the exhaust valve and the intake valve are elevatably secured, said cylinder head being formed as a cast product having integrated valve guide and valve seat, said case product being formed as aluminum alloy including silicon of 13.5 to 16 weight %.

18. A four-stroke cycle engine unit according to claim 12, wherein the piston-cylinder assembly is provided with a cylinder head to which the exhaust valve and the intake valve are elevatably secured, said cylinder head being formed as a cast product having integrated valve guide and valve seat, said cast product being formed as particle dispersion type light alloy.

19. A four-stroke cycle engine unit according to claim 1, wherein said intake and exhaust push rods each has one end formed in spherical shapes, said rocker arms each has a spherical portion against which spherical one end of the corresponding push rod abuts and is rockably secured to a cylinder head of the cylinder to which the exhaust and intake valves are elevatably attached, and said intake and exhaust lifters are mounted onto the corresponding intake and exhaust push rods by press fitting means or casting means, so that the rocker arms are rocked in accordance with the rocking motions of the lifters through spherical engagement of the push rods and the rocker arms.

20. A four-stroke cycle engine unit according to claim 19, wherein said intake and exhaust lifters are provided with through holes through which corresponding intake and exhaust push rods penetrate and another one ends of the push rods directly abut against an outer periphery of the cam means.

21. A four-stroke cycle engine unit according to claim 1, wherein either one of the crank gear and cam gear is provided with a hollow support body having an inner fitting hole into which the crank shaft is fitted and the support body has one side end portion to which is formed a gear-like tooth portion composed of a plurality of teeth.

22. A four-stroke engine unit according to claim 1, wherein said intake and exhaust push rods are crossed with each other and said exhaust valve and said intake valve are arranged with an angular difference.

23. A portable working machine provided with a four-stroke cycle engine unit of the structure according to claim 1, comprising:

a main body essentially consisting of the four-stroke cycle engine unit;

a working device driven by a four-stroke cycle engine unit;

a power transmission shaft member having one end connected to the four-stroke cycle engine unit and another end connected to the working device for transmitting an output power of the four-stroke cycle engine unit to the working device; and a handle means mounted onto the power transmission shaft member and operated by an operator.

24. A portable working machine provided with a four-stroke cycle engine unit of the structure according to claim 1, comprising:

a main body essentially consisting of the four-stroke cycle engine unit;

a working device driven by the four-stroke cycle engine unit;

a power transmission means having one end connected to the four-stroke cycle engine unit and another end connected to the working device for transmitting an output power of the four-stroke cycle engine unit to the working device, said power transmission means comprising either one of sprocket means, gear means and belt means disposed in a direction normal to the crank shaft of the four stroke cycle engine unit; and a handle means mounted onto the four-stroke cycle engine unit and operated by an operator.

25. A portable working machine according to claim 24, wherein the exhaust valve of the four-stroke cycle engine unit is arranged at a portion apart from the operator and the intake valve of the four-stroke cycle engine unit is positioned at a portion near the operator in a using state of the working machine, said exhaust valve and said intake valve being arranged with angular difference with each other and wherein the crank shaft of the four-stroke cycle engine unit is rotated in a clockwise direction and the cam means of the valve drive mechanism is rotated in a counterclockwise direction and the intake and exhaust push rods are crossed with each other.

26. A portable working machine according to claim 25, wherein the paired intake and exhaust lifters are rockably supported on a pair of spaced apart lifter axes, respectively.

27. A portable working machine according to claim 24, wherein said cam means comprises two cam members which corresponding intake and exhaust lifters contact and said exhaust valve and said intake valve arranged with an angular difference are driven by the intake and exhaust lifters through the crossing intake and exhaust push rods.

* * * * *

UNITED STATES PATENT AND TRADEMARK OFFICE

CERTIFICATE OF CORRECTION

PATENT NO. : 5,267,536

DATED : December 7, 1993

INVENTOR(S) : Youichi Imagawa et al.

It is certified that error appears in the above-identified patent and that said Letters Patent is hereby corrected as shown below:

Column 9, Line 31 :
After "center" replace "$B_0$" with --$A_0$--;

Signed and Sealed this

Ninth Day of August, 1994

Bruce Lehman

*Attest:*

BRUCE LEHMAN

*Attesting Officer*

*Commissioner of Patents and Trademarks*